US007867586B2

(12) United States Patent
Kamo et al.

(10) Patent No.: US 7,867,586 B2
(45) Date of Patent: Jan. 11, 2011

(54) ARTICLE HAVING MICROPOROUS BODY PART, PRODUCTION METHOD OF INK MEDIUM, DIFFUSION METHOD OF SULFUR-CONTAINING ORGANIC ACID INTO MICROPOROUS LAYER, PRODUCTION METHOD OF ARTICLE HAVING MEICROPOROUS BODY PART, AND INKJET RECORDING MEDIUM PRODUCED THEREFROM

(75) Inventors: Hisao Kamo, Ushiku (JP); Masanori Ito, Tokyo (JP); Takashi Sawada, Yokohama (JP); Muneyoshi Sunada, Tokyo (JP); Yasuyuki Ishida, Odawara (JP); Hiroshi Asakawa, Ebina (JP); Tsuyoshi Santo, Yokohama (JP); Mariko Suzuki, Kawasaki (JP); Satoko Ito, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 1270 days.

(21) Appl. No.: 11/396,627

(22) Filed: Apr. 4, 2006

(65) Prior Publication Data

US 2006/0182906 A1 Aug. 17, 2006

Related U.S. Application Data

(63) Continuation of application No. PCT/JP2005/019436, filed on Oct. 17, 2005.

(30) Foreign Application Priority Data

Oct. 15, 2004 (JP) ..... 2004-301819
Nov. 19, 2004 (JP) ..... 2004-336605

(51) Int. Cl.
*B41M 5/00* (2006.01)

(52) U.S. Cl. ..... 428/32.21; 428/32.24; 428/32.34

(58) Field of Classification Search ..... 428/32.21, 428/32.24, 32.34
See application file for complete search history.

(56) References Cited

U.S. PATENT DOCUMENTS 4,168,170 A * 9/1979 Mowrey et al. ..... 430/351

(Continued)

FOREIGN PATENT DOCUMENTS

EP 0 854 050 A2 7/1998

(Continued)

OTHER PUBLICATIONS

International Preliminary Report on Patentability and Written Opinion of the International Searching Authority for PCT/JP2005/019436, with translations (18 pages).

(Continued)

*Primary Examiner*—Betelhem Shewareged
(74) *Attorney, Agent, or Firm*—Fitzpatrick, Cella, Harper & Scinto

(57) ABSTRACT

Provided is an inkjet recording medium in which hydrated alumina and a sulfinic acid compound or thiosulfonic acid compound coexist in a pigment in an ink receiving layer, and which can prevent white-background yellowing during storage in a resin file holder or the like and ensure printing quality at the same time. The ink receiving layer of the inkjet recording medium contains the sulfinic acid compound or thiosulfonic acid compound, which functions to prevent yellowing, in a salt form or in a free form so as to be diffusible.

8 Claims, 5 Drawing Sheets

U.S. PATENT DOCUMENTS

| | | | | |
|---|---|---|---|---|
| 5,500,023 | A | 3/1996 | Koike et al. | 8/499 |
| 5,515,093 | A | 5/1996 | Haruta et al. | 347/101 |
| 5,540,764 | A | 7/1996 | Haruta et al. | 106/20 R |
| 5,635,291 | A | 6/1997 | Yoshino et al. | 428/304.4 |
| 5,658,376 | A | 8/1997 | Noguchi et al. | 106/31.43 |
| 5,698,478 | A | 12/1997 | Yamamoto et al. | 442/153 |
| 5,764,261 | A | 6/1998 | Koike et al. | 347/100 |
| 5,781,216 | A | 7/1998 | Haruta et al. | 347/106 |
| 5,782,967 | A | 7/1998 | Shirota et al. | 106/31.58 |
| 5,800,916 | A | 9/1998 | Yoshino et al. | 428/328 |
| 5,846,647 | A | 12/1998 | Yoshino et al. | 428/328 |
| 5,851,654 | A | 12/1998 | Yoshino et al. | 428/328 |
| 5,869,177 | A | 2/1999 | Yoshino et al. | 428/328 |
| 5,902,387 | A | 5/1999 | Suzuki et al. | 106/22 R |
| 5,922,625 | A | 7/1999 | Haruta et al. | 442/75 |
| 5,955,185 | A | 9/1999 | Yoshino et al. | 428/304.4 |
| 5,962,124 | A | 10/1999 | Yoshino et al. | 428/328 |
| 5,965,252 | A | 10/1999 | Santo et al. | 428/329 |
| 6,036,307 | A | 3/2000 | Hakamada et al. | 347/106 |
| 6,139,939 | A | 10/2000 | Haruta et al. | 428/195 |
| 6,214,963 | B1 | 4/2001 | Noguchi et al. | 528/71 |
| 6,338,891 | B1 | 1/2002 | Kawasaki et al. | 428/195 |
| 6,342,289 | B1 | 1/2002 | Eguchi et al. | 428/195 |
| 6,394,597 | B1 | 5/2002 | Koike et al. | 347/106 |
| 6,426,766 | B1 | 7/2002 | Shirota et al. | 347/106 |
| 6,500,525 | B1 | 12/2002 | Ogino et al. | 428/195 |
| 6,551,695 | B2 | 4/2003 | Kaneko et al. | 428/195 |
| 6,552,156 | B2 | 4/2003 | Noguchi et al. | 528/71 |
| 6,558,740 | B1 | 5/2003 | Santo et al. | 427/146 |
| 6,565,950 | B1 | 5/2003 | Tomioka et al. | 428/195 |
| 6,613,821 | B2 | 9/2003 | Suzuki et al. | 524/111 |
| 6,649,661 | B2 | 11/2003 | Yoshino et al. | 519/93 |
| 6,685,999 | B2 | 2/2004 | Ichinose et al. | 428/32.25 |
| 6,848,781 | B2 | 2/2005 | Ogino et al. | 347/105 |
| 6,874,881 | B2 | 4/2005 | Shirota et al. | 347/100 |
| 7,029,109 | B2 | 4/2006 | Shirota et al. | 347/100 |
| 7,055,943 | B2 | 6/2006 | Suzuki et al. | 347/100 |
| 7,625,614 | B2 * | 12/2009 | Kamo et al. | 428/32.31 |
| 2001/0014381 | A1 * | 8/2001 | Kaneko et al. | 428/195 |
| 2003/0186003 | A1 * | 10/2003 | Nakano et al. | 428/32.1 |
| 2004/0048008 | A1 | 3/2004 | Yoshino et al. | 428/32.1 |
| 2004/0058098 | A1 | 3/2004 | Kondo et al. | 428/32.1 |
| 2004/0066446 | A1 | 4/2004 | Yamaguchi et al. | 347/105 |
| 2004/0246321 | A1 * | 12/2004 | Takashima et al. | 347/100 |
| 2005/0007436 | A1 | 1/2005 | Ogino et al. | 347/105 |
| 2006/0141176 | A1 | 6/2006 | Kondo et al. | 428/32.26 |
| 2006/0188671 | A1 | 8/2006 | Kamo et al. | 428/32.34 |
| 2007/0093386 | A1 | 4/2007 | Ishikawa et al. | 503/227 |

FOREIGN PATENT DOCUMENTS

| | | | |
|---|---|---|---|
| EP | 1 459 901 | A2 | 9/2004 |
| JP | H07-232473 | | 9/1995 |
| JP | H07-232475 | | 9/1995 |
| JP | H08-132731 | | 5/1996 |
| JP | H09-066664 | | 3/1997 |
| JP | H09-076628 | | 3/1997 |
| JP | 2714350 | | 10/1997 |
| JP | 2714352 | | 10/1997 |
| JP | 10-193779 | | 7/1998 |
| JP | H11-34484 | | 2/1999 |
| JP | 2001-260519 | A | 9/2001 |
| JP | 2002-96546 | | 4/2002 |
| JP | 2003-1931 | | 1/2003 |
| JP | 2003-127536 | | 5/2003 |
| JP | 2003-291513 | | 10/2003 |

OTHER PUBLICATIONS

O.D. Bangee, et al., "Antioxidant-induced Yellowing of Textiles," Polymer Degradation and Stability, vol. 50, pp. 313-317 (1995).

W.H. Hemmpel, "Reversible Vergilbungen an Aviviertem Textilgut," Textile Praxis International Oct. (1980) 1213-1215.

Kenneth Smeltz, "Why Do White Fabrics and Garments Turn Yellow During Storage in Polyethylene Bags and Wrappings?" Textile Chemist and Colorist, vol. 15, pp. 52-56 (1983).

T. Martini; "Reflectance Curves of Optically Brightened Synthetic Fibre Materials After $NO_2$ and $SO_2$ Treatment," Textile Progress, vol. 15, pp. 16-24 (1987).

* cited by examiner

ARTICLE HAVING MICROPOROUS BODY PART, PRODUCTION METHOD OF INK MEDIUM, DIFFUSION METHOD OF SULFUR-CONTAINING ORGANIC ACID INTO MICROPOROUS LAYER, PRODUCTION METHOD OF ARTICLE HAVING MEICROPOROUS BODY PART, AND INKJET RECORDING MEDIUM PRODUCED THEREFROM

This application is a continuation of International Application No. PCT/JP2005/019436, filed Oct. 17, 2005, which claims the benefit of Japanese Patent Application No. 2004-301819, filed Oct. 15, 2004 and Japanese Patent Application No. 2004-336605, filed Nov. 19, 2004.

BACKGROUND OF THE INVENTION

1. Field of the Invention

The present invention relates to yellowing prevention technology in articles having a microporous body part (printing media such as a medium on which a photographic image is formed or a label on which ordinary printing is performed; or articles having, or partially having, an elastic microporous body or microporous body which is capable of swelling). In particular, the present invention also relates to a recording medium, and production method thereof, which has high-image quality and is capable of preventing yellowing over a long period of time, that is suitable for ink recording using aqueous inks.

The present invention also relates to a method for diffusing a sulfur-containing organic acid into a microporous layer, and a method for producing a recording medium for application in ink recording which uses an aqueous ink employing such diffusion method.

The present invention especially relates to an inkjet recording medium having a porous part composed of hydrated alumina, and a production method thereof, which does not impair printing quality after printing, has long-term image shelf-life, functions to prevent yellowing of a white-background during storage in a file holder, and can maintain yellowing prevention performance for at least a distribution storage period corresponding to a product life between production of the medium and printing in the medium is printed.

2. Related Background Art

Articles having microporous body parts are employed in a large number of fields. The inkjet recording field can be cited as a representative example. An inkjet recording method performs high image quality printing of images, characters or the like by employing a range of operating principles to cause microdroplets of a liquid for recording (recording liquid), such as an ink, to fly up and adhere onto a recording medium having a microporous body part. The recent spread of digital cameras, digital video, scanners, personal computers and other such devices has expanded the demand for printers which employ an inkjet recording system having such characteristics.

However, in the ink recording field, while printing quality is obviously demanded, also being demanded are maintenance of the white-background yellowing prevention effects during long-term storage in a resin file holder after printing, and a capability for preventing yellowing at least during the distribution period that is required for overseas ocean transport after production. Therefore, for inkjet recording media, characteristics of a high drying speed, excellent color developability of the colorant, high surface gloss and enabling image formation with a high resolution are being demanded. As a recording medium capable of providing an image comparable to a silver halide photograph, an inkjet recording medium has been realized which is composed of a fine inorganic pigment such as silica or alumina, and a binder for such a pigment, and in which a microporous body part with a high porosity as an ink receiving layer is layered on a support.

Japanese Patent Application Laid-Open No. H07-232475 discloses that hydrated alumina is preferable as a material to be used for an ink receiving layer, as dye adhesion in the ink is good as a result of hydrated alumina having a positive charge, and an image having excellent color developability can be attained. Hydrated alumina having a boehmite structure is disclosed as being more preferable due to its good dye adsorption properties, ink absorption properties and transparency.

However, a conventional recording medium provided with a porous site comprising a large number of microvoids as the ink receiving layer can sometimes undergo yellowing of the white background portion of the image over time if stored in some kind of file holder. It is known that since the microporous body part of a recording medium having such a structure possesses a large number of microvoids, if a medium is placed in a resin file and stored, a phenolic antioxidant, as represented by BHT (2,6-di-t-butyl-p-methylphenol) adheres to the ink receiving layer of the recording medium from the file holder, and is gradually oxidized to form a yellow oxide, whereby yellowing occurs. Regarding such yellowing due to BHT, documents such as "Polymer Degradation and Stability 50 (1995) 313-317", "Textil Praxis International Oktober (1980) 1213-1215", "Textile Chemist and Colorist April (1983) Vol. 15 No. 4 52-56" and "Text. Progr. 15 (1987) 16" disclose that the phenolic antioxidant oxidizes to a quinone methide structure, which then dimerizes and again oxidizes to form a yellow compound having a stilbene quinone structure.

Japanese Patent Application Laid-Open No. H11-34484 discloses an invention in which an organic acid or inorganic acid, such as maleic acid or hydrochloric acid is used as a yellowing countermeasure, to set the surface and interior pH of the ink receiving layer comprising hydrated alumina which has a pseudoboehmite structure in a range of between 4.0 and 5.4, inclusive thereof. Japanese Patent Application Laid-Open Nos. 2003-1931 and 2002-96546 describe a recording medium which comprises an ink receiving layer (containing silica) layered on a non-water-absorbent support, and a coating layer with a film surface pH adjusted to 4.2, the coating layer comprising a sulfur-containing organic compound such as a thioether compound, thiourea compound, disulfide compound, mercapto compound, sulfinic acid compound, or thiosulfonic acid compound, but comprising simply "an acid" in Examples, actually. In these documents, the film surface pH is given as between 2 and 6, preferably 3 and 5, although the reason for this is not clear.

Japanese Patent Application Laid-Open No. 2003-1931 describes a production method of an ink absorbing layer which contains a larger quantity of the above-described sulfur-containing organic compound in its lower layer portion than in its upper layer portion. Japanese Patent Application Laid-Open No. 2003-1931 further describes a production method for the same ink absorbing layer which consists of coating a non-water-absorbing support with a coating solution comprising a binder and the sulfur-containing organic compound, and a coating solution comprising inorganic fine particles and a binder. Japanese Patent Application Laid-Open No. 2003-1931 also discloses that since ink absorption properties deteriorate if the added amount of the acid for attaining a pH of 4.2 is increased, the sulfur-containing organic compound is added such that it does not contain any additives or in an amount of 0.1 to 0.3 g/m$^2$.

Japanese Patent Application Laid-Open No. 2002-96546 describes a recording material provided with an ink absorbing layer on a non-water-absorbing support and an upper layer which comprises the above-described sulfur-containing organic compound, wherein the sulfur-containing organic compound is present in a high concentration in the upper portion of the ink receiving layer. As production methods for such material, Japanese Patent Application Laid-Open No. 2002-96546 discloses a method which provides an ink absorbing layer onto a non-water-absorbing support and then coats an aqueous solution containing the above sulfur-containing organic compound; and a method which coats an aqueous solution containing silica and the above sulfur-containing organic compound onto an ink absorbing layer.

Japanese Patent Application Laid-Open No. 2003-291513 discloses the addition of an ammonium salt and acid for the purpose of improving yellowing resistance in the ink receiving layer. It is disclosed that the ammonium salt and acid are caused to fly up due to the drying during coating after a water-soluble resin for forming a colorant receiving layer has been cured, whereby as a result anions of the acid are caused to remain in the system, so that the pH of the colorant image receiving (colorant receiving) layer is reduced. Japanese Patent Application Laid-Open No. 2003-291513 also describes an inkjet recording sheet prepared by coating as a pigment 200 ml of a pH 3.5 coating solution which consists of a silica particulate, polyvinyl alcohol, boric acid, polyoxyethylenelauryl ether and ion-exchange water onto a colorant receiving layer, drying the coating solution, and then coating 20 g/m$^2$ of a coating solution to which sulfonic acid was added in an ammonium chloride salt and acid state. However, in this document, the oxidized ratio of retained BHT is simply decreased by the addition of the ammonium chloride salt and acid.

SUMMARY OF THE INVENTION

Based on Japanese Patent Application Laid-Open No. H07-232475, the present inventors investigated a recording medium according to Japanese Patent Application Laid-Open No. H07-232475 in which the surface and interior pH of the ink receiving layer was lowered. Their assessment showed that although three months after surface adjustment yellowing was effectively prevented, after an extended period of time of six months or more had elapsed, yellowing was not be prevented to an acceptable degree. In addition, a drop in the ink absorption properties as a consequence of the low surface pH took place, whereby yellowing prevention and printing quality could not be simultaneously satisfactorily attained. When stored for a length of time corresponding to the use-by date of the product, i.e. the time from after being produced until printing, external factors such as humidity caused the paper surface pH to rise, whereby the reactivity of the phenolic antioxidant was restored. This in turn caused yellowing to occur, which made the medium unacceptable for practical use. From these findings it was learned that the technical subject matter of Japanese Patent Application Laid-Open No. H07-232475 was to suppress yellowing of a phenolic antioxidant itself, as represented by BHT, by lowering the surface and interior pH of the ink receiving layer.

Based on the Working Examples of Japanese Patent Application Laid-Open No. 2003-1931, the present inventors evaluated an inkjet recording medium having a surface and interior pH of 4.2 in which a sulfur-containing organic compound was added in an amount such that ink absorption properties were not decreased. Their evaluation showed that although such a recording medium was also able to exhibit good yellowing prevention effects immediately after receiving layer formation, after storage in a product form for a length of time corresponding to product life, an unacceptable degree of yellowing had taken place. In addition, this recording medium also exhibited a drop in ink absorption properties as a consequence of the low surface and interior pH of 4.2, whereby yellowing prevention and printing quality could not be satisfactorily attained at the same time. The present inventors further produced and evaluated an ink receiving layer according to Japanese Patent Application Laid-Open No. 2003-1931 in which the silica was replaced with alumina; that is, an ink receiving layer comprising a sulfur-containing organic acid in the ink receiving layer, and a larger quantity being contained in the lower layer than the upper layer of the ink receiving layer. In this case, when the sulfur-containing organic acid salt was added into a hydrated alumina sol to adjust the coating solution for ink receiving layer formation, the hydrated alumina in the coating solution turned into a gel by agglomeration, causing the coating suitability to decrease, which is undesirable from a production control viewpoint. The present inventors also evaluated an ink receiving layer formed using the above-described coating solution comprising a sulfur-containing organic acid salt and alumina, in which a larger quantity was contained in the lower layer than the upper layer of the ink receiving layer, wherein after formation the paper surface pH was adjusted to 4.2. The evaluation showed that ink density decreased as a result of agglomeration, whereby an acceptable printing quality could not be attained, and which in some cases was not satisfactory in terms of long-term image shelf-life properties.

Based on Japanese Patent Application Laid-Open No. 2002-96546, the present inventors investigated a recording medium comprising a binder, a crosslinking agent and a sulfur-containing organic acid salt, wherein the pigment was changed from silica to hydrated alumina, and wherein after formation of the ink receiving layer an aqueous solution of the sulfur-containing organic compound was coated to adjust the paper surface pH to 4.2. Their evaluation showed that in the same manner as for Japanese Patent Application Laid-Open No. H07-232475, although good yellowing prevention performance was exhibited at three months, after six months an unacceptable degree of yellowing had occurred. In addition, ink absorption properties deteriorated due to the low paper surface pH and sulfur-containing organic compound being distributed in the ink fixing region of the receiving layer surface, whereby a satisfactory printing quality could not be attained.

Accordingly, the first to fifth objects of the present invention will now be described.

A first object is to provide a microporous body part which can eliminate any risk of yellowing through a novel conception, and not just by merely retaining a phenolic antioxidant, represented by BHT, which has entered into a microporous body part such as in the conventional art.

A second object is to provide a microporous body part which can appropriately deal with a phenolic antioxidant, represented by BHT, which continuously enters over an extended period of time into a microporous body part and thereby effectively eliminate the risk of yellowing.

A third object is to provide a microporous body part which can eliminate the risk of yellowing without harming the characteristics of the ink recording image of the hydrated alumina-containing microporous body part; i.e., a microporous body part which is capable of simultaneously satisfying yellowing prevention and printing quality.

A fourth object is to provide an inkjet recording medium in which hydrated alumina and a sulfur-containing organic acid are made to co-exist in the pigment in the ink receiving layer, which is a microporous body part, that can simultaneously satisfy: (1) white-background yellowing prevention during storage in a file holder or the like of an inkjet recording medium which has undergone printing; (2) printing quality; and (3) maintenance of the effects of (1) for a period corresponding to product life after production. The fourth object is also directed to providing a production method which can reliably achieve these characteristics.

A fifth object is to provide a layered structure, a production method thereof and a diffusion method, which can effectively diffuse a sulfur-containing organic acid into a microporous body part.

As a result of investigation into the first object, the present inventors discovered a reaction mechanism which fundamentally suppresses white-background yellowing, by noting that sulfinic acid compounds or thiosulfonic acid compounds react with the quinone methide formed during the yellowing process of the phenolic antioxidant such as BHT, thereby changing it into a reduced and inactivated structure, which results in dimerization and stilbene quinone formation being suppressed. The present inventors gained the insight that such an inactivated compound is not affected by external factors and is a stable structure which does not yellow.

However, further investigation by the present inventors of the second object revealed that if a sulfinic acid compound or thiosulfonic acid compound which has been made to exist in a microporous body part is subjected to a low pH condition such as that described in Japanese Patent Application Laid-Open Nos. H11-34484, 2003-1931, 2002-96546 and 2003-291513, the structure becomes unstable (decomposition from heating, decomposition from dilute acid), whereby the above-described reaction mechanism cannot be obtained.

In view of this, the present inventors learned from extensive investigation that if the sulfinic acid compound or thiosulfonic acid compound (hereinafter abbreviated to "certain sulfur-containing organic acid") is made to exist in a microporous body part in a diffusible state, i.e. a salt or ion-dissociated state, the above-described reaction mechanism can be made to work. The present inventors further discovered that if the diffusible certain sulfur-containing organic acid present in the surrounding area is made to be present in a suitable distribution inside a microporous body part so as to supplement the certain sulfur-containing organic acid which is consumed by the above-described reaction mechanism, when an article comprising a microporous body part is stored in a resin file holder, then an environment able to deal with the phenolic antioxidant such as BHT which enters into the microporous body part (hereinafter referred to as "yellowing prevention maintenance effects") for an extended period of time can be formed in the microporous body part. The reason why yellowing prevention maintenance effects for the microporous body parts corresponding to the white background portions of the article are generated is thought to be due to the following. During storage in the resin file holder, phenolic antioxidants which arrive at the surface of a microporous body part are inactivated by the sulfinic acid compound or thiosulfonic acid compound which are inside the site. If such compound is consumed in this manner, a concentration gradient forms at the interior or surface of said sites (preferably the ink receiving layer), whereby the compound is not in equilibrium. Because of this, the certain sulfur-containing organic acid present in a diffusible state in the sites moves by diffusion towards the surface of the microporous body part so as to return the system to an equilibrium. Thus, the certain sulfur-containing organic acid is newly supplied due to the presence of liquid deposited (atmospheric moisture and recording ink or the like) onto the microporous body parts of the recording ink.

However, if the above-described sulfur-containing organic acid salt is added into the hydrated alumina-comprising coating solution, such as in Japanese Patent Application Laid-Open No. 2003-1931, the hydrated alumina agglomerates by electrically bonding with the above-described sulfur-containing organic acid salt, which dramatically reduces printing quality. It was thus learned that the above-described method is not practical. Further, because yellowing during storage is caused by BHT being adsorbed into the ink fixing region, which is the surface portion of the receiving layer, to prevent yellowing over an extended period of time it is necessary to make a necessary amount of yellowing prevention agent to be present in the fixing region, which is the BHT adsorption location, and allow the above-described reaction mechanism to proceed. However, the addition of a necessary amount into the ink fixing region can adversely effect printing quality, for instance by reducing ink absorption properties.

In view of this, the present inventors discovered that by forming an ink receiving layer by coating a support with a first coating solution which comprises at least one selected from the group consisting of a sulfinic acid compound salt and a thiosulfonic acid, coating onto this a second coating solution comprising hydrated alumina and a binder, and then immediately drying, agglomeration of hydrated alumina, and therefore the drop in printing quality caused by agglomeration, does not occur at the region where ink fixes (hereinafter ink fixing region), which among the sites is usually further away from the support on the surface layer side, whereby hydrated alumina and the above-described certain sulfur-containing organic acid can be made to exist in a diffusible state in the ink receiving layer. An ink receiving layer formed using this method can allow a necessary amount of the certain sulfur-containing organic acid to be added into the ink fixing region which does not affect printing quality. Further, an ink receiving layer formed using this method can allow a necessary amount of certain sulfur-containing organic acid to be present over an extended period of time in areas close to the support (these are usually areas other than the ink fixing region) among the support and the microporous body parts, whereby printing quality and long-term yellowing prevention can be achieved. It is thought that when the first coating solution and second coating solution are used, the certain sulfur-containing organic acid inactivates and consumes the phenolic antioxidants in the ink fixing region, whereby the concentration gradient formed in the ink fixing region is brought closer to equilibrium. The certain sulfur-containing organic acid present in a diffusible state on or near to the support thus diffuses into the ink fixing region, whereby the certain sulfur-containing organic acid is newly supplied due to the presence of liquid (atmospheric moisture and recording ink or the like) deposited onto the ink receiving layer.

In order to maintain an even better white-background yellowing prevention capability for a period corresponding to the time from immediately after the ink receiving layer is formed to the printing use-by date of the article, it was learned that by setting the pH of the ink receiving layer to be higher than the dissociated pH of the sulfinic acid compound or thiosulfonic acid compound, the sulfinic acid compound or thiosulfonic acid compound can be made to exist in a stable state in the ink receiving layer for an extended period of time, whereby white-background yellowing suppression effects for the above-described use-by date can be maintained. Further, if the receiving layer pH can be set higher than dissociated pH of the sulfinic acid compound or thiosulfonic acid compound, i.e. a pH of 6.0 or higher, ink absorption properties are good, which has a positive effect on printing quality.

Based on the above discoveries, the present inventors created the below 1 to 50 aspects of the present invention which solve objects 1 to 5.

1. An article comprising a microporous body part which comprises a diffusible sulfinic acid compound or a diffusible thiosulfonic acid compound.

2. The article according to the above-described 1, wherein the microporous body part is an ink receiving layer formed on a support and the article is an ink recording medium.

3. The article according to the above-described 2, wherein the ink receiving layer comprises hydrated alumina, and the diffusible sulfinic acid compound or diffusible thiosulfonic acid compound is present in the range from 1.0% by mass or more to 13% by mass or less of the hydrated alumina, calculated as alumina.

4. The article according to the above-described 3, wherein the microporous body part has a surface and interior pH from 5.0 or more to 8.5 or less.

5. A method for producing an ink recording medium comprising the steps of forming on a support an ink receiving layer which consists of a microporous body part and which has a surface and interior pH from 6.0 or more to 8.5 or less; and coating the ink receiving layer with a coating solution which comprises a sulfinic acid compound or thiosulfonic acid compound in an ionic form or in a salt form.

6. The method for producing an ink recording medium according to the above-described 5, wherein the ink receiving layer is a pseudoboehmite layer formed by coating the support with a coating solution which comprises hydrated alumina and a binder.

7. The method for producing an ink recording medium according to the above-described 6, wherein the sulfinic acid compound or thiosulfonic acid compound is added in the coating step in an amount from 0.31 $g/m^2$ or more to 3.6 $g/m^2$ or less.

8. The method for producing an ink recording medium according to the above-described 7, wherein the sulfinic acid compound or thiosulfonic acid compound is added in the coating step in an amount from 0.36 $g/m^2$ or more to 2.9 $g/m^2$ or less.

9. The method for producing an ink recording medium according to the above-described 5, wherein the sulfinic acid compound or thiosulfonic acid compound is added in the coating step in an amount from 0.31 $g/m^2$ or more to 3.6 $g/m^2$ or less.

10. The method for producing an ink recording medium according to the above-described 9, wherein the sulfinic acid compound or thiosulfonic acid compound is added in the coating step in an amount from 0.36 $g/m^2$ or more to 2.9 $g/m^2$ or less.

11. A method for producing an article comprising a microporous body part, the method comprising:

a first coating step of coating a support with a coating layer comprising at least one sulfur-containing organic ion selected from the group consisting of a sulfinic acid compound and a thiosulfonic acid compound, and a cation which can form a salt with the sulfur-containing organic acid ion;

a second coating step of coating a coated surface which has undergone the first coating step with a second coating solution comprising inorganic fine particles which form a porous body;

a step of forming a microporous body part composed of the inorganic fine particles and a binder by drying; and a step of causing the microporous body part to absorb moisture.

12. The method for producing an article comprising a microporous body part according to the above-described 11, wherein the second coating solution for coating the coated surface which has undergone the first coating step comprises hydrated alumina and a binder.

13. The method for producing an article comprising a microporous body part according to the above-described 12, wherein the pH of the first coating solution is from 5.0 or more to 11.0 or less.

14. An inkjet recording medium produced according to the production method of the above-described 13, the inkjet recording medium comprising an ink receiving layer as the microporous body part on a support, wherein the ink receiving layer comprises hydrated alumina, a binder and at least one sulfur-containing organic acid selected from the group consisting of a diffusible sulfinic acid compound and a diffusible thiosulfonic acid compound, the ink receiving layer comprises a high concentration part with a relatively high sulfur-containing organic acid concentration and a low concentration part with a relatively low sulfur-containing organic acid concentration in the depth direction from the recording surface, and the high concentration part is located closer to the recording surface than the low concentration part.

15. The inkjet recording medium according to the above-described 14, wherein the at least one sulfur-containing organic acid selected from the group consisting of a diffusible sulfinic acid compound and a diffusible thiosulfonic acid compound is present in a range from 1.0% or more by weight to 8% or less by weight of the hydrated alumina calculated as alumina in a part with a depth from the recording surface of 20 μm of the ink receiving layer.

16. The inkjet recording medium according to the above-described 15, wherein the ink receiving layer has a surface and interior pH from 5.0 or more to 8.5 or less.

17. The inkjet recording medium according to the above-described 16, wherein the support is a water-absorbent support.

18. The inkjet recording medium according to the above-described 17, wherein the water-absorbent support comprises at least one selected from a diffusible sulfinic acid compound and a diffusible thiosulfonic acid compound.

19. The inkjet recording medium according to the above-described 14, wherein the ink receiving layer has a surface and interior pH from 5.0 or more to 8.5 or less.

20. The inkjet recording medium according to the above-described 19, wherein the support is a water-absorbent support.

21. The inkjet recording medium according to the above-described 20, wherein the water-absorbent support comprises at least one selected from a diffusible sulfinic acid compound and a diffusible thiosulfonic acid compound.

22. An inkjet recording medium produced according to the production method of the above-described 12, the inkjet recording medium comprising an ink receiving layer as the microporous body part on a support, wherein the ink receiving layer comprises hydrated alumina, a binder and at least one sulfur-containing organic acid selected from the group consisting of a diffusible sulfinic acid compound and a diffusible thiosulfonic acid compound, the ink receiving layer comprises a high concentration part with a relatively high sulfur-containing organic acid concentration and a low concentration part with a relatively low sulfur-containing organic acid concentration in the depth direction from the recording surface, and the high concentration part is located closer to the recording surface than the low concentration part.

23. The inkjet recording medium according to the above-described 22, wherein the at least one sulfur-containing organic acid selected from the group consisting of a diffusible sulfinic acid compound and a diffusible thiosulfonic acid compound is present in the range from 1.0% by weight or more to 8% by weight or less of the hydrated alumina calculated as alumina in a part with a depth from the recording surface of 20 μm of the ink receiving layer.

24. The inkjet recording medium according to the above-described 23, wherein the ink receiving layer has a surface and interior pH from 5.0 or more to 8.5 or less.

25. The inkjet recording medium according to the above-described 24, wherein the support is a water-absorbent support.

26. The inkjet recording medium according to the above-described 25, wherein the water-absorbent support comprises at least one selected from a diffusible sulfinic acid compound and a diffusible thiosulfonic acid compound.

27. The inkjet recording medium according to the above-described 22, wherein the ink receiving layer has a surface and interior pH from 5.0 or more to 8.5 or less.

28. The inkjet recording medium according to the above-described 27, wherein the support is a water-absorbent support.

29. The inkjet recording medium according to the above-described 28, wherein the water-absorbent support comprises at least one selected from a diffusible sulfinic acid compound and a diffusible thiosulfonic acid compound.

30. The method for producing an article comprising a microporous body part according to the above-described 11, wherein the pH of the first coating solution is 5.0 or more to 11.0 or less.

31. An inkjet recording medium produced according to the production method of the above-described 30, the inkjet recording medium comprising an ink receiving layer as the microporous body part on a support, wherein the ink receiving layer comprises hydrated alumina, a binder and at least one sulfur-containing organic acid selected from the group consisting of a diffusible sulfinic acid compound and a diffusible thiosulfonic acid compound, the ink receiving layer comprises a high concentration part with a relatively high sulfur-containing organic acid concentration and a low concentration part with a relatively low sulfur-containing organic acid concentration in the depth direction from the recording surface, and the high concentration part is located closer to the recording surface than the low concentration part.

32. The inkjet recording medium according to the above-described 31, wherein the at least one sulfur-containing organic acid selected from the group consisting of a diffusible sulfinic acid compound and a diffusible thiosulfonic acid compound is present in the range from 1.0% by weight or more to 8% by weight or less of the hydrated alumina calculated as alumina in a part with a depth from the recording surface of 20 μm of the ink receiving layer.

33. The inkjet recording medium according to the above-described 32, wherein the ink receiving layer has a surface and interior pH from 5.0 or more to 8.5 or less.

34. The inkjet recording medium according to the above-described 33, wherein the support is a water-absorbent support.

35. The inkjet recording medium according to the above-described 34, wherein the water-absorbent support comprises at least one selected from a diffusible sulfinic acid compound and a diffusible thiosulfonic acid compound.

36. The inkjet recording medium according to the above-described 31, wherein the ink receiving layer surface and interior has a pH is from 5.0 or more to 8.5 or less.

37. The inkjet recording medium according to the above-described 36, wherein the support is a water-absorbent support.

38. The inkjet recording medium according to the above-described 37, wherein the water-absorbent support comprises at least one selected from a diffusible sulfinic acid compound and a diffusible thiosulfonic acid compound.

39. An inkjet recording medium produced according to the production method of the above-described 11, the inkjet recording medium comprising an ink receiving layer as the microporous body part on a support, wherein the ink receiving layer hydrated alumina, a binder and at least one sulfur-containing organic acid selected from the group consisting of a diffusible sulfinic acid compound and a diffusible thiosulfonic acid compound, the ink receiving layer comprises a high concentration part with a relatively high sulfur-containing organic acid concentration and a low concentration part with a relatively low sulfur-containing organic acid concentration in the depth direction from the recording surface, and the high concentration part is located closer to the recording surface than the low concentration part.

40. The inkjet recording medium according to the above-described 39, wherein the at least one sulfur-containing organic acid selected from the group consisting of a diffusible sulfinic acid compound and a diffusible thiosulfonic acid compound is present in the range from 1.0% by weight or more to 8% by weight or less of the hydrated alumina calculated as alumina in a part with a depth from the recording surface of 20 μm of the ink receiving layer.

41. The inkjet recording medium according to the above-described 40, wherein the ink receiving layer has a surface and interior pH from 5.0 or more to 8.5 or less.

42. The inkjet recording medium according to the above-described 41, wherein the support is a water-absorbent support.

43. The inkjet recording medium according to the above-described 42, wherein the water-absorbent support comprises at least one selected from a diffusible sulfinic acid compound and a diffusible thiosulfonic acid compound.

44. The inkjet recording medium according to the above-described 39, wherein the ink receiving layer has a surface and interior pH from 5.0 or more to 8.5 or less.

45. The inkjet recording medium according to the above-described 44, wherein the support is a water-absorbent support.

46. The inkjet recording medium according to the above-described 45, wherein the water-absorbent support comprises at least one selected from a diffusible sulfinic acid compound and a diffusible thiosulfonic acid compound.

47. An article comprising a layer for supplying sulfur-containing organic acid which comprises at least one sulfur-containing organic acid ion selected from the group consisting of a sulfinic acid compound and thiosulfonic acid compound and a cation which forms a salt with the sulfur-containing organic acid ion; and a microporous body part layered on the layer for supplying sulfur-containing organic acid, wherein the microporous body part is water permeable from one surface towards the other surface at least in the layered direction, and wherein the sulfur-containing organic acid is diffusible from the layer for supplying sulfur-containing organic acid into the microporous body region.

48. A method for producing the article according to the above-described 47, comprising a step of forming on a substrate a layer for supplying sulfur-containing organic acid which comprises at least one sulfur-containing organic acid selected from the group consisting of a sulfinic acid compound and a thiosulfonic acid compound and a cation which forms a salt with the sulfur-containing organic acid ion; and a step of forming a microporous body part on the layer for supplying sulfur-containing organic acid.

49. A method for diffusing at least one sulfur-containing organic acid selected from the group consisting of a sulfinic acid compound and thiosulfonic acid compound into a microporous body part, the method comprising the steps of:

forming an article in which a microporous body part, which is water permeable at least from one surface towards another surface in the layered direction, is layered on a layer for supplying sulfur-containing organic acid, which comprises at least one sulfur-containing organic acid ion selected from the group consisting of a sulfinic acid compound and a thiosulfonic acid compound and a cation which forms a salt with the sulfur-containing organic acid ion; and diffusing the at least one sulfur-containing organic acid ion selected from the group consisting of a sulfinic acid compound and thiosulfonic acid compound into the microporous body part.

50. An article which is capable of absorbing moisture or water, comprising a porous body part having a surface and interior pH of 5.0 or more, and an adjacent part which comprises a sulfur-containing organic acid salt or ion at a location continuous with the part.

The first and second objects will be mainly resolved by aspects 1 to 4 and 50.

The third object will be mainly resolved by aspects 14 to 29 and 31 to 46.

The fourth object will be mainly resolved by aspects 5 to 10, 14 to 29 and 31 to 46.

The fifth object will be mainly resolved by aspects 11 to 13, 30 and 47 to 49.

DESCRIPTION OF THE PREFERRED EMBODIMENTS

Figure 1A:
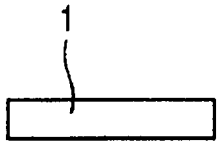
FIGS. 1A, 1B, 1C, 1D, 1E and 1F are process diagrams illustrating one example of a method for producing the recording medium according to the present invention wherein a sulfinic acid compound or thiosulfonic acid compound is added by overcoating.

A best mode of the article according to the present invention is where the ink receiving layer of an inkjet recording medium comprises a diffusible certain sulfur-containing organic acid in a microporous body part constituted from hydrated alumina. Here, "diffusible" in an ink receiving layer refers to the state where diffusion is possible from external factors such as humidity or the supply of moisture via deposition of an aqueous ink or the like, as a result of a sulfur-containing organic acid being present in a salt form or an ion-dissociated state in an ink receiving layer after the ink receiving layer has been formed. The certain sulfur-containing organic acid is preferably present in an ink receiving layer which has a higher pH than the dissociated pH of the certain sulfur-containing organic acid. The certain sulfur-containing organic acid is can be made more stable in a salt or ion-dissociated diffusible state, and can be stored in a state which maintains long-term yellowing prevention effects. Separate to the coating step of the hydrated alumina-comprising coating solution, by providing a coating step of a coating solution which comprises the certain sulfur-containing organic acid, whereby the certain sulfur-containing organic acid is made to be present in a diffusible state close to the support of the ink receiving layer, it is possible to achieve printing quality and yellowing prevention during resin file holder storage.

The method for producing the article according to the present invention was devised based on the knowledge that a laminated structure in which, in the case of a recording medium, microporous body parts are layered on a sulfur-containing organic acid supply layer, which comprises at least one sulfur-containing organic acid ion selected from the group consisting of a sulfinic acid compound and a thiosulfonic acid compound, and cations for forming the sulfur-containing organic acid ion and salt, can effectively diffuse the sulfur-containing organic acid into the microporous body parts from the sulfur-containing organic acid supply layer in conjunction with moisture movement within the microporous body parts. Examples of moisture movement which can be employed include movement of moisture-containing air within the microporous body parts, and movement which is caused by deposition of moisture into the micropores. Since the microporous body parts are water-permeable from at least one surface of a given laminate direction (acceptable if moisture movement occurs in a direction which intersects with the laminate direction) to the other surface, the sulfur-containing organic acid can diffuse in at least the laminate layer direction. That is, by either making moisture absorbable, or water absorbable, the above-described sulfur-containing organic acid salt or ion can be diffused into the porous layer. Part or all of the sulfur-containing organic acid supply layer which comprises cations for forming the sulfur-containing organic acid ion and salt may be provided in the microporous body parts.

The present invention will now be explained for a case when an ink receiving layer is used as the microporous structure.

A best mode of the production method for the article according to the present invention is where the ink receiving layer of an inkjet recording medium comprises a diffusible certain sulfur-containing organic acid in an ink receiving layer constituted from hydrated alumina. Here the term "diffusible" in an ink receiving layer refers to the state, and the method for producing such state, where diffusion is possible from external factors such as humidity or the supply of moisture via deposition of an aqueous ink or the like, as a result of a sulfur-containing organic acid being present in a salt form or an ion-dissociated state in an ink receiving layer after the ink receiving layer has been formed.

However, if hydrated alumina and a sulfur-containing organic acid are mixed in the ink receiving layer forming coating solution, i.e. a coating solution comprising hydrated alumina charged with sulfur-containing organic acid ions, the hydrated alumina and the sulfur-containing organic acid electrically bond, and form an agglomerate. During ink receiving layer formation, such agglomerate is bound by the binder, so that the sulfur-containing organic acid ions cannot freely diffuse in the ink receiving layer. Therefore, just by simply adding a sulfur-containing organic acid into a hydrated alumina-containing coating solution based on the conventional art, it was difficult to achieve effective yellowing prevention while maintaining the recording characteristics of the recording medium.

The certain sulfur-containing organic acid is preferably present in an ink receiving layer which has a higher pH than the dissociated pH of the certain sulfur-containing organic acid. The certain sulfur-containing organic acid can be made more stable in a salt or ion-dissociated diffusible state, and can be stored in a state which maintains long-term yellowing prevention effects. Separate to the coating step of the hydrated alumina-comprising coating solution, by providing a coating step of a coating solution which comprises the certain sulfur-containing organic acid, whereby the certain sulfur-containing organic acid is made to be present in a diffusible state close to the support of the ink receiving layer, it is possible to achieve printing quality and yellowing prevention during resin file holder storage.

The present invention will now be explained in detail with reference to preferable embodiments.

Hydrated Alumina

As the hydrated alumina used in the present invention, substances represented by the below general formula X, for example, can be preferably used.

$$Al_2O_3\text{-}n(OH)_2n\cdot mH_2O \quad (X)$$

(wherein n denotes any of 0, 1, 2 or 3, m denotes a value in the range of 0 to 10, and preferably 0 to 5, however m and n may not both be 0; since $mH_2O$ in many cases denotes a removable aqueous phase which does not participate in the formation of the crystal lattice, m may be a value which is an integer or a non-integer; however, if a material of such a species is heated, m may attain a value of 0) The crystal structure of hydrated alumina is known to, depending on the temperature for thermal processing, transform from amorphous, gibbsite type, or boehmite type alumina hydroxide to γ, σ, η, θ, and α type alumina oxides. In the present invention, any of the crystal structures may be used. Examples of preferable hydrated alumina which can be used in the present invention include hydrated alumina which exhibits from X-ray diffraction analysis a boehmite structure or is amorphous. In particular, examples include the hydrated alumina disclosed in Japanese Patent Application Laid-Open Nos. H07-232473, H08-132731, H09-066664, H09-076628 and the like.

While adjustment of the pore properties occurs during the production process, a hydrated alumina having a pore volume of from 0.3 ml/g or more to 1 ml/g or less is preferably used in order to fill the above-described ink receiving layer BET specific surface area and pore volume. More preferable is from 0.35 ml/g or more to 0.9 ml/g or less. Hydrated alumina having a pore volume within this range is preferable in terms of setting the pore volume of the ink receiving layer within the above-described prescribed range. For the BET specific surface area, hydrated alumina from 50 ml/g or more to 350 ml/g or less is preferably used, and more preferable is from 100 ml/g or more to 250 ml/g or less. Hydrated alumina having a BET specific surface area within this range is preferable in terms of setting the specific surface area of the ink receiving layer within the above-described prescribed range. The BET method as recited in the present invention is a powder surface area measurement method by gas-phase absorption, which calculates the total surface area possessed by 1 g of a test sample from an absorption isotherm, i.e. a method for calculating specific surface area. Nitrogen gas is often used as the normal absorption gas, and a method which calculates the absorbed amount from the change in pressure or volume of the gas being absorbed is most commonly employed. The most prominent method for representing an isotherm of polymer absorption is the Brunauer, Emmett, Teller equation, referred to as the BET equation widely used in surface area determination. Based on the BET equation, the adsorbed amount is calculated, whereby the surface area can be obtained by multiplying the calculated value by the surface area taken up by the one adsorbed molecule on the surface.

Certain Sulfur-Containing Organic Acid

As the certain sulfur-containing organic acid, at least one selected from the group consisting of the above-described sulfinic acid compound or thiosulfonic acid compound can be used. Sulfinic acid compounds and thiosulfonic acid compounds are represented below in general formulas I and II.

General formula I

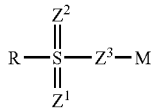

(wherein $R^1$ denotes a substituted or unsubstituted saturated aliphatic chain, a substituted or unsubstituted unsaturated aliphatic chain, a substituted or unsubstituted aryl, or a substituted or unsubstituted heteroaryl group; $Z^1$ and $Z^2$ independently denote oxygen, sulfur, N—$R^2$ or N—$NR^3R^4$; $Z^3$ denotes oxygen or sulfur; and M is a counterion capable of canceling the negative charge of $Z^3$; however, $Z^1$, $Z^2$ and $Z^3$ may not all be oxygen; $R^2$ denotes a substituted or unsubstituted saturated aliphatic chain, a substituted or unsubstituted unsaturated aliphatic chain or a hydroxyl group; and $R^3$ and $R^4$ independently denote a substituted or unsubstituted saturated aliphatic chain or a substituted or unsubstituted unsaturated aliphatic chain)

General formula II

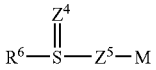

(wherein $R^5$ denotes a substituted or unsubstituted saturated aliphatic chain, a substituted or unsubstituted unsaturated aliphatic chain, a substituted or unsubstituted aryl, or a substituted or unsubstituted heteroaryl group; $Z^4$ independently denotes oxygen, sulfur, N—$R^6$ or N—$NR^7R^8$; $Z^5$ denotes oxygen or sulfur; M is a counterion capable of canceling the negative charge of $Z^5$; $R^6$ denotes a substituted or unsubstituted saturated aliphatic chain, a substituted or unsubstituted unsaturated aliphatic chain or a hydroxyl group; and $R^7$ and $R^8$ independently denote a substituted or unsubstituted saturated aliphatic chain or a substituted or unsubstituted unsaturated aliphatic chain)

Examples of the substituent groups for when $R^1$ and $R^5$ are substituted include an alkyl group, aryl group, alkoxy group, aryloxy group, alkylthio group, arylthio group, alkylsulfonyl group, arylsulfonyl group, carbonamide group, sulfonamide group, carbamoyl group, sulfamoyl group, alkylsulfoxy group, arylsulfoxy group, ester group, hydroxy group, carboxy group, sulfo group and a halogen atom, wherein one or more of these substituent groups may be substituted. These substituent groups may also be bound to each other to form a ring. In addition, these substituent groups may be a homopolymer, or a portion of a copolymer chain.

Preferable compounds in general formula I include thiosulfono=O-acid, thiosulfono=S-acid, dithiosulfono=O-acid, dithiosulfono=S-acid, sulfonotrithio acid, sulfonimide acid, sulfonimidethio=O-acid, sulfonimidethio=S-acid, sulfonohydrazone acid, sulfonimide acid, sulfonodiimide acid and sulfohydrazoneimide acid.

Preferable compounds in general formula II include thiosulfino=O-acid, thiosulfino=S-acid, dithiosulfino=O-acid, dithiosulfino=S-acid, sulfinotrithio acid, sulfonimide acid, sulfonimidethio=O-acid, sulfonimidethio=S-acid, sulfinohydrazone acid, sulfonimide acid, sulfinodiimide acid and sulfinohydrazoneimide acid.

More preferable compounds in general formulas I and II include those compounds given below. Especially preferable compounds include, but are not limited to, I-1, I-2, I-3, I-4, II-1, II-2, II-3, and II-4.

II-1

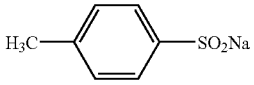

II-2

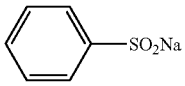

II-3

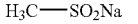

II-4

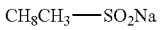

-continued

II-5

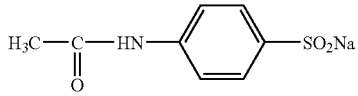

II-6

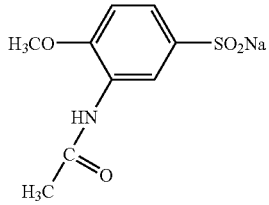

II-7

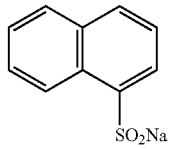

II-8

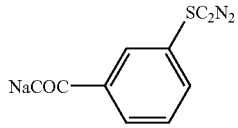

I-1

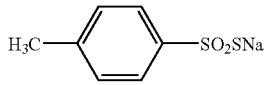

I-2

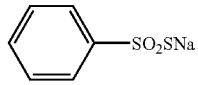

I-3

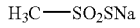

I-4

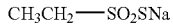

I-5

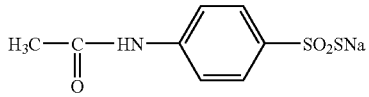

I-6

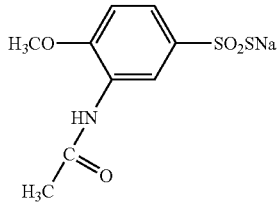

I-7

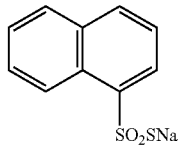

I-8

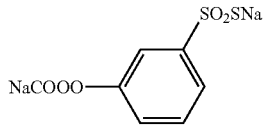

Examples of counterions for the above-described certain sulfur-containing organic acid and salt include metals and ammonia. Preferable examples include alkali metals such as sodium and potassium. The certain sulfur-containing organic acid salt may also be a hydrate.

It is known that during storage in a resin file folder, phenolic antioxidants in the resin file folder adhere to the ink receiving layer and are then oxidized over time to form quinone methide (formula 5). The quinone methide dimerizes, and then forms a stilbene quinone, which causes white-background yellowing. If the certain sulfur-containing organic acid is added to the ink receiving layer, the certain sulfur-containing organic acid reacts with the quinone methide, whereby the quinone methide is reduced and inactivated. One example of this is illustrated below by the inactivation reaction and the reaction product (formula 6) from general formula II-1.

Reaction formula I

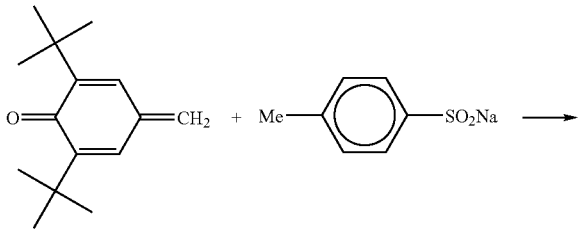

(formula 5)

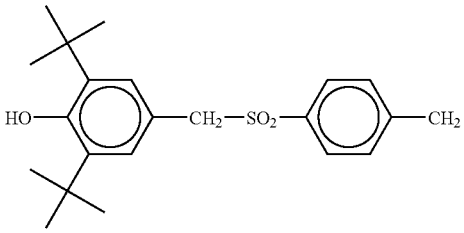

(formula 6)

Such compound is colorless and does not cause yellowing over time, whereby it is possible to prevent yellowing. Examples of such inactivated and achromatized compounds include, but are not limited to, the below.

(formula 7)

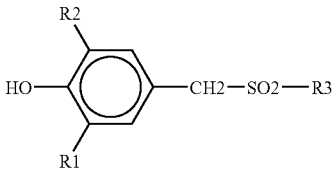

R1 and R2 denote hydrogen or a substituted or unsubstituted alkyl group; R3 denotes a substituted or unsubstituted saturated aliphatic chain, a substituted or unsubstituted unsaturated aliphatic chain, a substituted or unsubstituted aryl, or a substituted or unsubstituted heteroaryl group.

(formula 8)

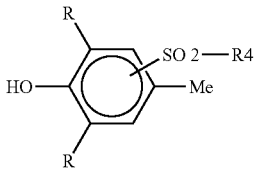

R denotes hydrogen or a substituted or unsubstituted alkyl group; and R4 denotes a substituted or unsubstituted saturated aliphatic chain, a substituted or unsubstituted unsaturated aliphatic chain, a substituted or unsubstituted aryl, or a substituted or unsubstituted heteroaryl group.

It is thought that, in the same manner as a sulfinic acid compound, a thiosulfonic acid compound reacts with quinone methide to form a compound represented by formulas 7 or 8 or an ester of thiosulfonic acid, whereby reduction and inactivation are carried out.

To confirm the presence of the above-described compounds in an ink receiving layer, after long-term storage in a resin file holder of a recording medium comprising in its ink receiving layer alumina and the diffusible certain sulfur-containing organic acid, the recording medium is immersed for about an hour in an alcohol, such as ethanol or methanol, whereby confirmation can be performed by using LC-MS or NMR on the immersed liquid.

If the certain sulfur-containing organic acid itself has a pH lower than that of its dissociated pH, the organic acid is unstable and susceptible to decomposition. This, in turn, over time causes the compounds represented by general formula II to decompose into sulfonic acid and disulfoxide, which do not have any yellowing prevention effect, thus reducing yellowing prevention performance. Further, the compounds represented by general formula I decompose into sulfonic acid and sulfur, whereby yellow sulfur, which can cause white-background yellowing, is formed in the ink receiving layer. For this reason, by making the surface and interior pH of the ink receiving layer higher than the dissociated pH of the certain sulfur-containing organic acid, the certain sulfur-containing organic acid which is diffusible in the ink receiving layer does not decompose even if stored after production in a product form for a period (distribution period) corresponding to the time taken for transport overseas by ocean transport. This makes it possible for the yellowing prevention effects to be maintained for a much greater length of time.

If the surface and interior pH of the ink receiving layer is in the dissociated pH region, in the drying step which is performed after the certain sulfur-containing organic acid-containing coating solution is coated onto the support, initial drying is performed such that the free acid of the certain sulfur-containing organic acid and the ion-dissociated species are mixed in an equilibrium. However, as drying proceeds the free acid is precipitated out. To maintain equilibrium wherein the certain sulfur-containing organic acid of the ion-dissociated state is turned into free acid, it was learned that, after drying, either the yellowing prevention effects decreased due to decomposition of the certain sulfur-containing organic acid during the distribution time, or that it was difficult to maintain the yellowing prevention effects during file holder storage, because the certain sulfur-containing organic acid in the ink receiving layer was in an acid state; that is, the certain sulfur-containing organic acid was largely present in the ink receiving layer in a non-diffusible and unstable state. However, even adjusting the pH to below the certain sulfur-containing organic acid dissociated pH after formation of the certain sulfur-containing organic acid-containing ink receiving layer, non-diffusible acids are similarly freed during the drying process, thereby rendering the certain sulfur-containing organic acid less stable and shortening the yellowing prevention period. If the surface and interior pH of the ink receiving layer is set within the dissociated pH region, in the drying step performed during the ink receiving layer formation step, a large quantity of the certain sulfur-containing organic acid transfers to an acid state, and is thus present after formation in an acid state in the ink receiving layer.

Accordingly, it is preferable to adjust the paper surface pH of the ink receiving layer to a value higher than the certain sulfur-containing organic acid dissociated pH, and make the certain sulfur-containing organic acid in the ink receiving layer to be present in a salt or ion-dissociated diffusible state. Confirmation of whether the certain sulfur-containing organic acid is present in a salt or ion-dissociated diffusible state can be carried out by measuring the surface and interior pH of the ink receiving layer. When the certain sulfur-containing organic acid is in a diffusible state, the certain sulfur-containing organic acid can be detected by soaking the recording medium, whose surface and interior pH of the ink receiving layer has been adjusted using hydrochloric acid or sodium hydroxide, in a ion-exchange water solution at 25° C. for 3 minutes and then employing LC-MS, HPLC or similar method.

The surface and interior pH, which is a broader region than the dissociated pH of the certain sulfur-containing organic acid, is preferably 5.0 or greater, and more preferably 6.0 or greater. The ink receiving layer pH is preferably set to 8.5 or less in view of yellowing prevention performance, and more preferably 7.5 or less. Setting the ink receiving layer pH to more than 5.0 is effective in increasing ink absorption properties and in terms of printing quality. In view of these points, the surface and interior pH of the ink receiving layer is preferably from 6.0 or more to 8.5 or less, and more preferably from 6.0 or more to 7.5 or less.

The surface and interior pH of the ink receiving layer after the ink receiving layer formation step can be adjusted to a fixed surface and interior pH by pH adjustment of the respective coating solutions, or by coating an alkali or acid after the ink receiving layer formation step. Examples of an acid which can be used for pH adjustment include, but are not limited to, an inorganic acid such as nitric acid, sulfuric acid, hydrochloric acid or phosphoric acid, or an organic acid. Preferable examples of the alkali include, but are not limited to, sodium hydroxide, potassium hydroxide and the like.

Surface pH measurement may be conducted in accordance with method A (coating method) among the surface and interior pH measurements prescribed by Japan Technical Association of the Pulp & Paper Industry (J.TAPPI). For example, the surface pH of the ink receiving layer can be measured using a paper surface pH measuring kit (MPC model) manufactured by Kyoritsu Chemical-Check Lab., Corp., suitable for the above-describe method A. The interior pH of the ink receiving layer can be measured by, after the surface pH measurement by the above-described method, using a microscope on a cross-section prepared using a microtome. Measurement can be carried out by, when measuring the surface pH, using the microscope to ascertain the cross-section prepared using the microtome after the coating solution of the test kit has completely penetrated the ink receiving layer by the above-described method, and visually comparing the coloration level of the range from the recording surface to the support with the test kit color sample.

If silica is used in the ink receiving layer pigment (generally silica itself does not fix the colorant, it forms micropores), thereby providing sufficient ink fixing capability, a cationic polymer must be added for colorant fixing other than silica. To provide the cationic properties, the ink receiving layer pH must be set to around 4.5. The use of silica is, therefore, undesirable in view of stability maintenance of the certain sulfur-containing organic acid salt for the reasons described above. On the other hand, if hydrated alumina is used in the ink receiving layer, stability maintenance of the certain sulfur-containing organic acid in the ink receiving layer and printing quality can be simultaneously attained as hydrated alumina exhibits effective ink fixing properties even at a pH greater than the dissociated pH of the certain sulfur-containing organic acid. Hydrated alumina is, therefore, preferably contained in combination with the certain sulfur-containing organic acid salt.

If the diffusible certain sulfur-containing organic acid is added to the ink receiving layer in an excess certain sulfur-containing organic acid concentration with respect to the hydrated alumina, printing density decreases and printing quality deteriorates. Therefore, to attain a good printing density, the certain sulfur-containing organic acid concentration in the ink fixing region is preferably a 13% by mass content or less, and more preferably 10% by mass or less. In terms of yellowing prevention effects, it is preferable to add 1.1% by mass or more with respect to the alumina in the hydrated alumina calculated as alumina.

The added amount of the certain sulfur-containing organic acid is preferably 0.31 $g/m^2$ or more, and more preferably 0.36 $g/m^2$ or more, in view of yellowing prevention. In view of printing quality, such as ink absorption properties, the added amount is preferably 3.6 $g/m^2$ or less, and more preferably 2.9 $g/m^2$ or less.

The mass % of the certain sulfur-containing organic acid with respect to the alumina in the hydrated alumina in the ink fixing region of the ink receiving layer can be measured on a cross-section prepared using a microtome from measurement of the abundance ratio of sulfur to alumina using TOF-SIMS, from the sulfur content in the certain sulfur-containing organic acid and the alumina content in the hydrated alumina, as a mass % of the hydrated alumina of the certain sulfur-containing organic acid present in a diffusible state in the ink fixing region.

The certain sulfur-containing organic acid content in the ink receiving layer is preferably a molar ratio of 1 or more to 400 or less with respect to the phenolic antioxidant and the like contained per resin file holder unit surface area, and a molar ratio of from 10 or more to 100 or less is more preferable. The phenolic antioxidant content per resin file holder unit surface area can be measured by headspace GC-MS.

Examples of a method for forming the diffusible certain sulfur-containing organic acid-containing ink receiving layer include forming an ink receiving layer on a non-water-absorbing or water-absorbing support, and then coating a certain sulfur-containing organic acid-containing coating solution to incorporate the certain sulfur-containing organic acid into the ink receiving layer. The certain sulfur-containing organic acid and the hydrated alumina are not contained in the same coating solution.

Examples of the method for forming the certain sulfur-containing organic acid-containing ink receiving layer according to the present invention include the below three methods.

(1) A method comprising a first coating step of forming onto a support a coating layer comprising hydrated alumina and a binder; a first drying step of drying the coating layer; a second coating step of coating a second coating solution which comprises at least one sulfur-containing organic acid ion selected from the group consisting of a sulfinic acid compound and a thiosulfonic acid compound, and cations for forming a sulfur-containing organic acid ion and salt; and a second drying step of obtaining an ink receiving layer in which a diffusible certain sulfur-containing organic acid is present.

(2) A method comprising a first coating step of coating onto a support a first coating solution which comprises at least one sulfur-containing organic acid ion selected from the group consisting of a sulfinic acid compound and a thiosulfonic acid compound, and cations for forming a sulfur-containing organic acid ion and salt, and after the first coating step; a second coating step of forming a coating layer which comprises hydrated alumina and a binder onto a coated surface of the first coating step; and a drying step which dries the coating layer for obtaining an ink receiving layer in which a diffusible certain sulfur-containing organic acid is present.

(3) A method comprising a first coating step of coating onto a support a first coating solution which comprises at least one sulfur-containing organic acid ion selected from the group consisting of a sulfinic acid compound and a thiosulfonic acid compound, and cations for forming a sulfur-containing organic acid ion and salt; and after the first coating step, a second coating step of forming a coating layer which comprises hydrated alumina and a binder onto a coated surface of the first coating step; a first drying step of drying the coating layer; a third coating step of coating onto the ink receiving layer a second coating solution comprising the sulfur-containing organic acid and cations for forming the sulfur-containing organic ion and salt; and a second drying step of obtaining an ink receiving layer in which a diffusible certain sulfur-containing organic acid is present.

The above-described method (2) deposits in advance the sulfur-containing organic acid ion and the cations for forming the sulfur-containing organic ion and salt onto the ink receiving layer, and is a method which forms the ink receiving layer on the deposited portion. The above-described method (3) deposits in advance the sulfur-containing organic acid ion and cations for forming the sulfur-containing organic ion and salt onto the ink receiving layer, and is a method which further adds a sulfur-containing organic acid salt after the ink receiving layer has been formed on the deposited portion. In neither of these methods is the sulfur-containing organic acid and the hydrated alumina contained in the same coating solution.

Each of the methods will now be explained.

Method (1)

First, a coating solution comprising hydrated alumina and a binder is coated onto a support to form a coating layer. This coating layer is dried to form an ink receiving layer. The drying step binds the hydrated alumina particles in the coating layer to each other with the binder, and is carried out to reliably define a porous structure having the characteristics of an ink receiving layer. This reliable provision of a porous structure is carried out under the required conditions such as temperature and time. If a crosslinking agent for the binder is contained in the coating solution, the crosslinking agent strengthens the binding performance of the binder, whereby a stronger ink receiving layer structure can be obtained. At the stage wherein a structure serving as such an ink receiving layer has been reliably defined, a coating solution comprising the certain sulfur-containing organic acid in a salt form for yellowing prevention is coated onto the ink receiving layer, whereby the certain sulfur-containing organic acid is incorporated into the ink receiving layer. Since the hydrated alumina particles are fixed in the ink receiving layer by the binder, agglomerates do not form as a result of the addition (incorporation) of the certain sulfur-containing organic acid as described above into the coating solution, whereby the structure of the ink receiving layer can be maintained. In contrast, if the certain sulfur-containing organic acid solution is overcoated onto the coating layer (which will be the ink receiving layer) while the coating layer after coating of the coating solution for ink receiving layer formation still remains, or at a stage where the desired porous structure has not yet been properly defined, the hydrated alumina and the certain sulfur-containing organic acid form a salt, whereby hydrated alumina agglomerates are formed, which adversely affects printing quality.

Preferable examples of a method for forming an ink receiving layer according to this method include those having the following steps.

Step A: Surface treatment step of coating a pre-coating solution (which does not contain a certain sulfur-containing organic acid)

Step B: Step of coating a coating solution which comprises hydrated alumina, a binder and a crosslinking agent Step C: Step of coating a coating solution in which a certain sulfur-containing organic acid salt is dissolved Either one of the above coating steps A or C may be carried out once, or can be carried out by breaking up into multiple steps wherein coating solutions having a different coating solution composition, or coating solutions having the same composition are coated. Step C can be replaced by a step wherein once the certain sulfur-containing organic acid-containing coating solution has been coated, a counterion of the certain sulfur-containing organic acid is formed, and a coating solution containing a salt-formable ion is coated. Although the drying step is a step intended to dry the ink receiving layer after all coating steps have been completed, a drying step can also be inserted in between any of the steps. In this case, the drying temperature is preferably from 80° C. or more to 170° C. or less, and more preferably from 90° C. or more to 150° C. or less. If the certain sulfur-containing organic acid is added into the ink receiving layer wherein the surface and interior pH is lower than the dissociated pH of the certain sulfur-containing organic acid, the certain sulfur-containing organic acid is susceptible to decomposition at a temperature of 50° C. or higher, whereby the yellowing prevention effects are decreased. For this reason, and also to prevent a reduction in the yellowing prevention performance under the above-described drying conditions, the surface and interior pH of the ink receiving layer should be higher than the dissociated pH of the certain sulfur-containing organic acid, preferably set to a surface and interior pH higher than 6.0.

The surface treatment step of the support is the step A which coats a pre-coating solution comprising a binder and a crosslinking agent that causes a crosslinking reaction to occur for curing. This step may be carried out as necessary. The addition of this crosslinking agent is preferable in terms of strengthening the structure serving as the ink receiving layer having desired porous sites formed mainly from hydrated alumina in the ink receiving layer. The surface treatment step A is also a step which coats onto the support a pre-coating solution which comprises a binder and a crosslinking agent which causes a crosslinking reaction to occur for curing, and is a step which coats onto a support a pre-coating solution that is a coating solution comprising one kind or more selected from the group consisting of boric acid and borate. The pre-coating solution is an aqueous solution comprising the above-described crosslinking agent, wherein it is preferable to contain from 1% by mass or more to 10% by mass or less of the crosslinking agent.

In the surface treating step, the substrate surface is not dried after being coated onto the water-absorbent support. This step is to coat a coating solution for forming the next ink receiving layer wherein the substrate surface retains its moisture to a certain degree (a coated solution state or an increased-viscosity state are acceptable). To improve the wettability of the pre-coating solution, adjustment of the surface tension and water absorbing capacity can be carried out by adding a surfactant, alcohol or the like to the pre-coating solution. The coating amount of the pre-coating solution in the surface treatment step is from 0.05 $g/m^2$ or more to 3.0 $g/m^2$ or less calculated as the solid content of the boric acid and borate.

Figure 1B:
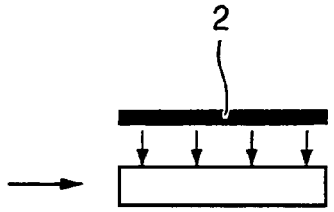
Figure 1C:
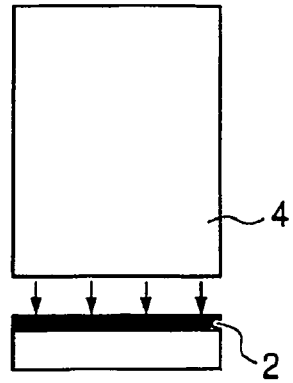
Figure 1D:
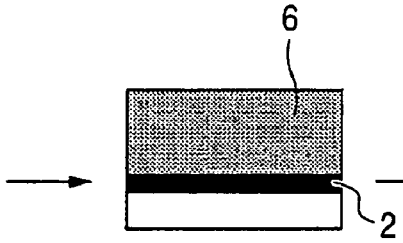
Figure 1E:
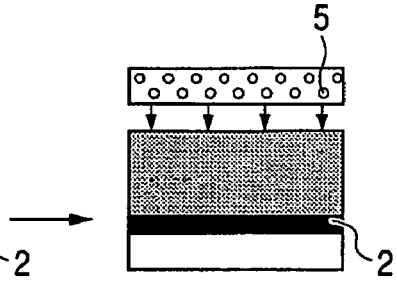
Figure 1F:
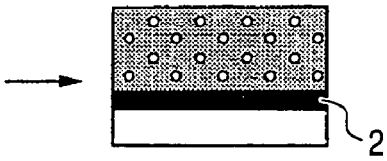

One example of this method is illustrated in FIGS. 1A to 1F. First, the water-absorbent support 1 illustrated in FIG. 1A is prepared, and a pre-coating solution 2 which does not contain a certain sulfur-containing organic acid is coated onto the ink receiving layer forming surface of the support as illustrated in FIG. 1B. Next, as illustrated in FIG. 1C, a coating solution 4, which comprises at least hydrated alumina and a binder, for forming the ink receiving layer is coated onto the pre-coating solution 2 coating surface, and dried to thereby form an ink receiving layer 6 as illustrated in FIG. 1D. An ink receiving layer is obtained as a result of this drying treatment which has the desired properly defined porous structure. Next, as illustrated in FIG. 1E, a coating solution to which the certain sulfur-containing organic acid 5 has been added in a salt form is coated onto the ink receiving layer 6 and dried, to thereby obtain the inkjet recording medium as illustrated in FIG. 1F in which a diffusible certain sulfur-containing organic acid is distributed in the ink receiving layer.

The coating solution used in step C is a solution in which a certain sulfur-containing organic acid has been dissolved in a solvent. Although the solvent can be selected so as to match the used certain sulfur-containing organic acid, preferably an aqueous solution of the certain sulfur-containing organic acid salt is used. In step C, if a high-concentration certain sulfur-containing organic acid salt solution is used to coat the certain sulfur-containing organic acid from the ink receiving layer surface, the certain sulfur-containing organic acid concentration rises, which causes the printing density to drop. To obtain good printing density in the present method, a coating solution adjusted to 20% by mass or less of the certain sulfur-containing organic acid is preferable, and especially preferable is a solution adjusted to 2% by mass or more to 10% by mass or less. In the coating solution used in step C, the above-described certain sulfur-containing organic acid and a substance which can form the salt of the certain sulfur-containing organic acid are both dissolved. The ratio of cations with respect to the certain sulfur-containing organic acid in the coating solution is preferably 1.0 or greater. The solvent used to dissolve the above-described organic acid salt is acceptable as long as it can dissolve the organic acid salt. Preferable examples include, but are not limited to, ion-exchange water, methanol, ethanol or the like, and more preferable is ion-exchange water. In terms of increasing production efficiency it is preferable to employ a coating solution wherein a mixed solvent, which combines a plurality of water-based and solvent-based solvents, is used to simultaneously dissolve the organic acid salt and a below-described other additive such as a hindered amine. While the pH of the coating solution in which the organic acid salt has been dissolved in a solvent is not limited, from 4.0 or more to 10.0 or less is preferable. More preferable is from 6.0 or more to 8.5 or less.

Figures 2A, 2B, 2C:
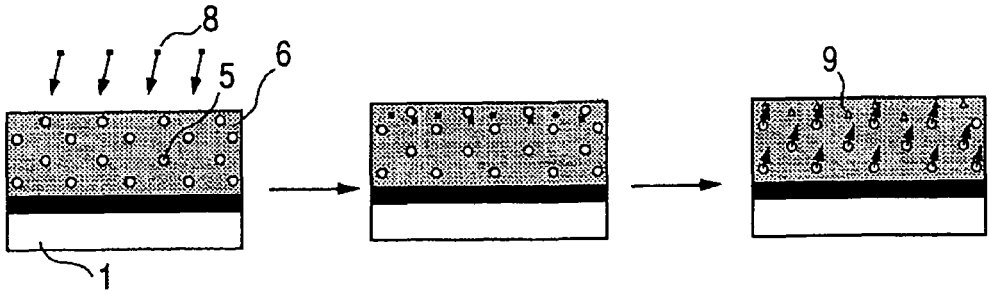
FIGS. 2A, 2B, 2C and 2D are diagrams which illustrate the yellowing prevention mechanism for the recording medium according to the present invention.
Figure 2D:
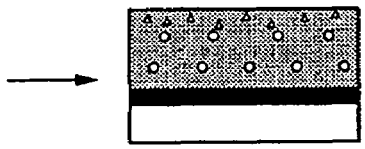

First, as illustrated in FIG. 2A, a yellowing causing substance 8 such as a phenolic antioxidant contained in a resin file holder for instance, adheres from the support 1, the layer 2 consisting of a pre-coating solution deposited on the support 1, and the surface of the recording medium consisting of an ink receiving layer 6 provided on the layer 2. If the yellowing causing substance 8 penetrates into the ink receiving layer as illustrated in FIG. 2B, the certain sulfur-containing organic acid salt 5 already contained in the ink receiving layer 6 reacts with this substance, and changes the yellowing causing substance to form an achromatized reaction product 9. Further, since the certain sulfur-containing organic acid salt 5 is contained in the ink receiving layer in a manner such that it is diffusible (movable) through the ink receiving layer, as illustrated in FIGS. 2C and 2D, unreacted certain sulfur-containing organic acid salt 5 diffuses into the region wherein the certain sulfur-containing organic acid 5 was consumed in decolorization in order to move the concentration gradient, which has formed between the region wherein the certain sulfur-containing organic acid 5 was consumed in decolorization and the region containing the certain sulfur-containing organic acid, closer to equilibrium. This mechanism leads to the inactivation of yellowing causing substances which could not be inactivated in FIG. 2B, whereby the yellowing causing substances are supplied to the adhering recording surface vicinity, thus maintaining the yellowing prevention effects.

Method (2)

First, a coating solution comprising a sulfinic acid compound or thiosulfonic acid compound, and cations which are capable of forming the organic acid and salt thereof is coated onto a support. A coating solution comprising hydrated alumina and a binder is then coated to form a coating layer. This coating layer is dried to form an ink receiving layer.

The drying step of the coating layer which is to become an ink receiving layer binds the hydrated alumina particles in the coating layer to each other with the binder, and is carried out to reliably define a porous structure having the characteristics of an ink receiving layer. The drying step is carried out under the temperature and time conditions which are required for reliable definition of the porous structure before the sulfur-containing organic acid salt or ions provided in advance on the support affect the formation of the desired porous structure of the ink receiving layer. If a crosslinking agent of the binder is contained in the coating solution, the crosslinking agent strengthens the binding performance of the binder, whereby a stronger ink receiving layer structure can be obtained. By reliably defining the porous structure of the ink receiving layer in this manner, the sulfur-containing organic acid salt or ions which are supplied to a lower layer can move in the ink receiving layer while maintaining this porous structure. As a result, agglomerates do not form from the addition of the sulfur-containing organic acid salt into the coating solution, whereby the structure of the ink receiving layer can be maintained. By making the sulfur-containing organic acid to be present in the ink receiving layer in a salt form, or in an ion-dissociated state, movement within the ink receiving layer is possible due to the addition of moisture from external factors such as humidity. This, in turn, allows the yellowing prevention effects to be efficiently manifested in the ink receiving layer.

Adding the sulfur-containing organic acid in a salt form means that the sulfur-containing organic acid and counterions are present in the ink receiving layer, whereby it is thought that the fact that the sulfur-containing organic acid does not electrically bond to the hydrated alumina is also a factor in the sulfur-containing organic acid being able to move within the ink receiving layer.

If ink receiving layer formation is slow, sulfur-containing organic acid salt added into the lower layer disperses into the coated later, thereby forming the same state as if the sulfur-containing organic acid salt or sulfur-containing organic acid in the coating solution had been mixed with the hydrated alumina. This results in not only the sulfur-containing organic acid being unable to be present in a dispersable manner in the ink receiving layer, but also results in the hydrated alumina and the sulfur-containing organic acid forming agglomerates in the coating layer, whereby an ink receiving layer is formed containing large grain size agglomerates. Consequently, haze and OD reduction occurs, whereby the quality of the finished article can be impaired. Therefore, once the hydrated alumina-containing coating solution has been coated, it is preferable to quickly carrying out the drying so as to avoid hydrated alumina agglomerates from forming in a depth region where the ink of the receiving layer is fixed, i.e. about a 20 μm range from the receiving layer surface.

Preferable examples of a method for forming an ink receiving layer according to this method (2) include those having the following steps.

Step A1: Surface treatment step of coating a pre-coating solution (which does not contain a sulfur-containing organic acid)

Step A2: Surface treatment step of coating a coating solution which contains cations for forming a sulfur-containing compound and salt.

Step B: Step of coating a coating solution which comprises hydrated alumina, a binder and a crosslinking agent Drying step: Step which dries the coating solution for forming a receiving layer The coating sequence comprises carrying out coating step A1, coating step A2, and after these are finished, to carry out step B. Either of coating steps A1 and A2 can be carried out first. Further, a step of adding a sulfinic acid compound salt and/or thiosulfonic acid compound salt to a pre-coating solution can serve as either step A1 or A2. Steps A1 and A2 can be combined as one step. It is also acceptable to coat step A1 after the coating of step A2. The respective steps of steps A1, A2 and B can be carried out by coating once, or can be carried out as steps for coating which are broken up into multiple steps of coating solutions having a different coating solution composition, or coating solutions having the same composition. Step A2 can be replaced by a step wherein once the coating solution which contains a sulfinic acid compound and/or thiosulfonic acid compound has been coated, a counterion of such certain sulfur-containing organic acid is formed, and a coating solution containing a salt-formable ion is coated. The coating solution containing a salt-formable ion may be provided during the steps prior to step B, or after ink receiving layer formation. Examples of the coating solution containing a salt-formable ion include, but are not limited to, potassium hydroxide, sodium hydroxide and potassium carbonate solutions.

After undergoing step A2, it is not preferable to coat the layer which is to become the ink receiving layer by step B after the surface treatment layer has been completely dried, because it becomes more difficult for the certain sulfur-containing organic acid present in the surface treatment layer to diffuse into the layer which is to become the ink receiving layer. Further, if step B is carried out with liquid puddles on the surface, there is the danger that cracks may form in the ink receiving layer. Therefore, the start time for step B is preferably from 5 seconds or more to 80 seconds or less, and more preferably 10 seconds or more to 20 seconds or less, after the step A2 treatment.

The drying step is carried out to dry the ink receiving layer after all coating steps have been completed. A drying step can also be inserted in between any of the steps as necessary. However, in such case, the drying step of formation of the ink receiving layer is preferably provided immediately after the coating in step B, since the adverse effects regarding the porous structure of the ink receiving layer are reduced. The drying temperature in each drying step is preferably from 80° C. or more to 170° C. or less, and more preferably from 90° C. or more to 150° C. or less. When a certain sulfur-containing organic acid is added into the ink receiving layer wherein the surface and interior pH is lower than the dissociated pH of the certain sulfur-containing organic acid, the certain sulfur-containing organic acid is susceptible to decomposition at a temperature of 50° C. or higher, whereby yellowing prevention effects are decreased. For this reason, and also to prevent a reduction in the yellowing prevention performance under the above-described drying conditions, the surface and interior pH of the ink receiving layer should be higher than the dissociated pH of the certain sulfur-containing organic acid, preferably set to a surface and interior pH higher than 5.0. While the pH of the step A1 coating solution and the coating solution of step A2, which contains a sulfur-containing compound salt, is not limited, from 4.0 or more to 11.0 or less is preferable. More preferable is from 6.0 or more to 10 or less.

One surface treatment step of the support is a step A1 for coating a pre-coating solution which comprises a binder and a crosslinking agent that causes a crosslinking reaction to occur for curing. This step may be carried out as necessary. The addition of this crosslinking agent is preferable in terms of strengthening the structure serving as the ink receiving layer having desired porous sites formed mainly from hydrated alumina in the ink receiving layer. The surface treatment step A1 is also a step of coating onto the support a pre-coating solution which comprises a binder and a crosslinking agent which causes a crosslinking reaction to occur for hardening, and is a step which coats onto a support a pre-coating solution that is a coating solution comprising one kind or more selected from the group consisting of boric acid and borate. The pre-coating solution is an aqueous solution comprising the above-described crosslinking agent, wherein it is preferable to contain from 1% by mass or more to 10% by mass or less of the crosslinking agent.

If the steps A1 and A2 are carried out as a single step, or if the coating in step A1 is performed after the step A2 coating, the boric acid and borate in the pre-coating solution of step A1 can pass through more easily, whereby crack formation after the ink receiving layer is formed can be suppressed, which improves yield and is also effective in terms of production efficiency.

In the surface treating step, the substrate surface is not dried after being coated onto the water-absorbent support. This step is to coat a coating solution for forming the next ink receiving layer wherein the substrate surface retains its moisture to a certain degree (a coated solution state or an increased-viscosity state are acceptable). To improve the wettability of the pre-coat solution, adjustment of the surface tension and water absorbing capacity can be carried out by adding a surfactant, alcohol or the like to the pre-coating solution. The coating amount of the pre-coating solution in the surface treatment step is from 0.05 $g/m^2$ or more to 3.0 $g/m^2$ or less calculated as the solid content of the boric acid and borate.

Figures 3A, 3B, 3C:
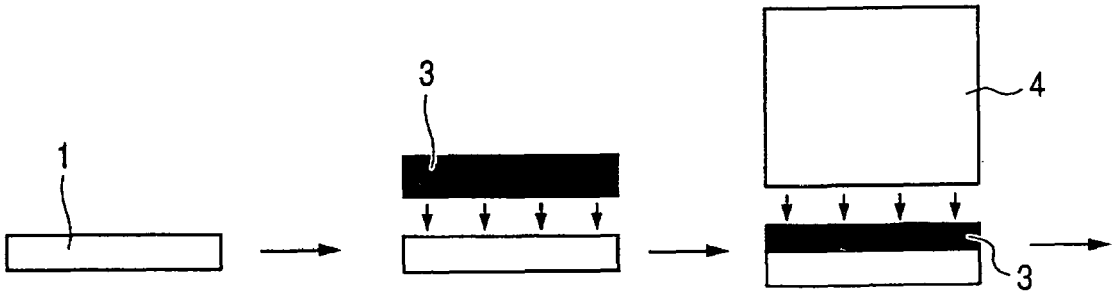
FIGS. 3A, 3B, 3C, 3D, 3E and 3F are process diagrams illustrating one example of a method for producing the recording medium according to the present invention wherein a sulfinic acid compound or thiosulfonic acid compound is added by pre-coating.
Figures 3D, 3E, 3F:
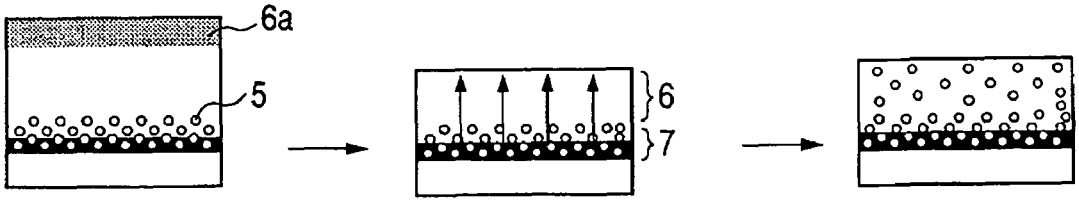

One example of this method (2) is illustrated in FIGS. 3A to 3F. First, the support 1 illustrated in FIG. 3A is prepared, and a pre-coating solution 3, which contains a certain sulfur-containing organic acid or certain sulfur-containing organic acid ions, and cations for forming a salt, is coated onto the ink receiving layer forming surface of the support as illustrated in FIG. 3B. Next, as illustrated in FIG. 3C, a coating solution 4, which comprises at least hydrated alumina for forming the ink receiving layer and a binder, is coated onto the coating layer consisting of the pre-coating solution 3, and dried to thereby form a coating layer surface. As a result of this drying treatment, the coating layer is dried in a depth direction going from the surface, whereby the formation of the porous structure proceeds in the depth direction. On the other hand, a sulfur-containing organic acid 5, which was already added from the pre-coating solution 3, disperses in the coating layer 6*a*, thereby causing an agglomeration reaction among the hydrated alumina in that portion. By the stage of FIG. 3D, the surface portion of the coating layer 6*a* is dry, and sulfur-containing organic acid is dispersed in the portion of the support 1 side. As drying proceeds further, by FIG. 3E, there are formed a portion which has become an ink receiving layer 6 as a result of drying before the sulfur-containing organic acid diffused therein, and a hydrated alumina agglomerate layer 7 from the sulfur-containing organic acid. As drying proceeds still further, moisture from the hydrated alumina agglomerate layer 7 also moves towards the ink receiving layer 6 surface, and is released from the surface. As a result of the movement of the moisture, the sulfur-containing organic acid 5 disperses into the ink receiving layer in a salt form or free state. In such a manner, an inkjet recording medium having the structure illustrated in FIG. 3F is obtained.

Figure 4A:
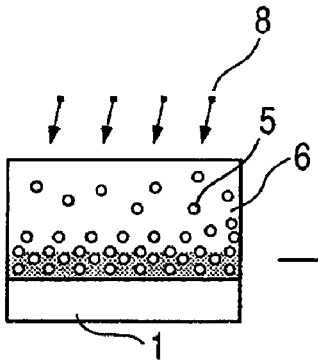
FIGS. 4A, 4B, 4C and 4D are diagrams which illustrate the yellowing prevention mechanism for the recording medium according to the present invention.
Figure 4B:
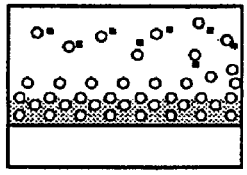
Figure 4C:
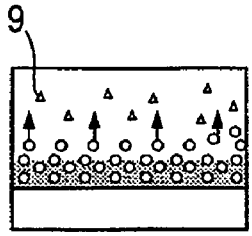
Figure 4D:
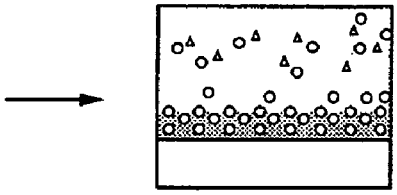

In a recording medium obtained by the method explained using FIGS. 3A to 3F, a relatively large quantity of the diffusible certain sulfur-containing organic acid is present in the hydrated alumina agglomerate layer 7 (region illustrated by FIG. 3E). The yellowing prevention performance in such a recording medium can be thought to be from the action schematically illustrated in FIGS. 4A to 4D. First, as illustrated in FIG. 4A, a yellowing causing substance 8 such as a phenolic antioxidant contained in a resin file holder for instance, adheres from the recording medium surface. If the yellowing causing substance 8 penetrates into the ink receiving layer as illustrated in FIG. 4B, the certain sulfur-containing organic acid salt 5 already contained in the ink receiving layer 6 reacts with this substance, and changes the yellowing causing substance to form an achromatized reaction product 9. Further, since the certain sulfur-containing organic acid salt 5 is contained in the ink receiving layer in a manner such that it is diffusible (movable) through the ink receiving layer, as illustrated in FIGS. 4C and 4D, unreacted certain sulfur-containing organic acid salt 5 diffuses into the region wherein the certain sulfur-containing organic acid 5 was consumed in decolorization in order to move the concentration gradient, which has formed between the region wherein the certain sulfur-containing organic acid 5 was consumed in decolorization and the region containing the certain sulfur-containing organic acid, closer to equilibrium. This mechanism leads to the inactivation of yellowing causing substances which were unable to be inactivated in FIG. 4B, whereby the yellowing causing substances are supplied to the adhering recording surface vicinity, thus maintaining the yellowing prevention effects. Accordingly, duration of yellowing prevention performance depends on the total amount of sulfur-containing organic acid salt contained in the ink receiving layer, and in particular, on the retained amount of sulfur-containing organic acid salt in the support-side hydrated alumina agglomerate region.

Method (3)

The ink receiving layer formed in the above method (2) may be further supplied with a sulfinic acid compound salt and/or cations for forming thiosulfonic acid ion and salt by an overcoat technique. In such case, it is preferable to carry out coating with an overcoat solution adjusted to a concentration which does not adversely impact on printing quality. In addition, the sulfur-containing organic acid salt which is overcoated onto the ink receiving layer and the sulfur-containing organic acid salt provided in advance from step A2 onto support may be the same or different. Further, the amount of sulfur-containing organic acid contained in the coating solution employed on the support prior to ink receiving layer formation and that in the coating solution employed in the ink receiving layer can be set so that a sufficient amount is supplied to the recording medium in order to attain the yellowing prevention effects in the ink receiving layer. However, it is preferable to set the sulfur-containing compound salt for coating on the support prior to ink receiving layer formation to a relatively high amount, and the sulfur-containing compound salt supplied by overcoating to a relatively low amount, as a distribution can be attained such that sulfur-containing organic acid concentration increases in accordance with the depth from the recording medium surface side, which enables printing quality and yellowing prevention to be achieved simultaneously.

For this method (3), preferable examples may include those methods comprising the below steps.

Step A1: Surface treatment step of coating a pre-coating solution (which does not contain a sulfur-containing organic acid)

Step A2: Surface treatment step of coating a coating solution which contains cations for forming a sulfur-containing organic acid compound and salt Step B: Step of coating a coating solution which comprises hydrated alumina, a binder and a crosslinking agent Step C: Overcoating step of coating a coating solution in which a sulfur-containing organic acid salt is dissolved The coating sequence comprises carrying out step B once step A1 and step A2 are finished, and then carrying out a drying step followed by the overcoating step C. The steps A1, A2, B and the drying step can be carried out in accordance with what was described for method (2). Further, in the same manner as in method (2), step A2 can be replaced by a step wherein once the coating solution which contains a sulfinic acid compound and/or thiosulfonic acid compound has been coated, a counterion of such certain sulfur-containing organic acid is formed, and a coating solution containing a salt-formable ion is coated. The coating solution containing a salt-formable ion may be provided during the steps prior to step B, after ink receiving layer formation, and after the overcoating step (step C). After undergoing step A2, it is not preferable to coat the layer which is to become the ink receiving layer by step B after the surface treatment layer has been completely dried, because it is more difficult for the certain sulfur-containing organic acid present in the surface treatment layer to diffuse into the layer which is to become the ink receiving layer. Further, if step B is carried out with liquid puddles on the surface, there is the danger that cracks mat form in the ink receiving layer. Therefore, the start time for step B is preferably from 5 seconds or more to 80 seconds or less, and more preferably 10 seconds or more to 20 seconds or less, after the step A2 treatment.

In the same manner as the above-described external addition and internal addition methods, coating for the A2 and C coating steps can be carried out once, or a plurality of times.

Figure 5A:
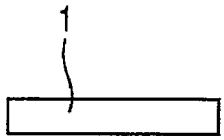
FIGS. 5A, 5B, 5C, 5D, 5E, 5F, 5G and 5H are process diagrams illustrating one example of a method for producing the recording medium according to the present invention wherein a sulfinic acid compound or thiosulfonic acid compound is added by pre-coating and overcoating.
Figure 5B:
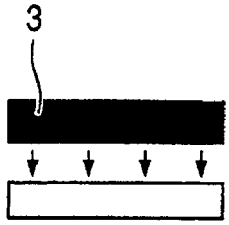
Figure 5C:
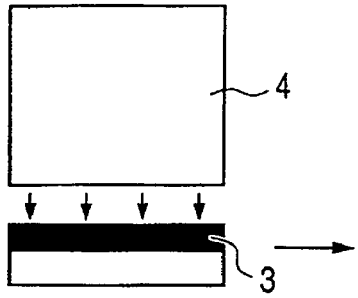
Figure 5D:
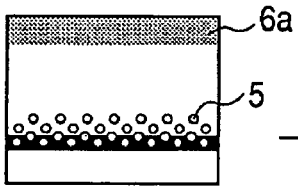
Figure 5E:
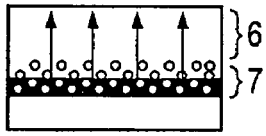
Figure 5F:
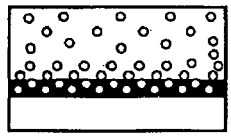
Figure 5G:
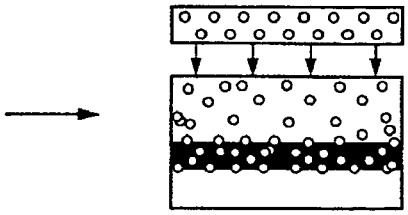
Figure 5H:
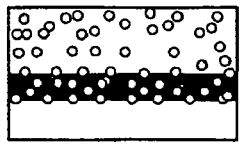

One example of this method (3) is illustrated in FIGS. 5A to 5H. First, the support 1 illustrated in FIG. 5A is prepared, and a pre-coating solution 3, which contains a sulfur-containing organic acid salt or sulfur-containing organic acid ions, and cations for forming a salt, is coated onto the ink receiving layer forming surface of the support as illustrated in FIG. 5B. Next, as illustrated in FIG. 5C, a coating solution 4, which comprises at least hydrated alumina for forming the ink receiving layer and a binder, is coated onto the coating layer consisting of the pre-coating solution 3, and dried to thereby form a coating layer surface. As a result of this drying treatment, the coating layer is dried in a depth direction going from the surface, whereby the formation of the porous structure proceeds in the depth direction. On the other hand, a sulfur-containing organic acid 5, which was already added from the pre-coating solution 3, disperses into the coating layer 6*a*, thereby causing an agglomeration reaction of the hydrated alumina in that portion. By the stage of FIG. 5D, the surface portion of the coating layer 6*a* is dry, and sulfur-containing organic acid is dispersed in the portion of the support 1 side. As drying proceeds further, by FIG. 5E, there are formed a portion which has become an ink receiving layer 6 as a result of drying before the sulfur-containing organic acid diffused therein, and a hydrated alumina agglomerate layer 7 from the sulfur-containing organic acid. As drying proceeds still further, moisture from the hydrated alumina agglomerate layer 7 also moves towards the ink receiving layer 6 surface, and is released from the surface. As a result of the movement of the moisture, the sulfur-containing organic acid 5 disperses into the ink receiving layer in a salt form or free state. Next, as illustrated in FIG. 5F, a coating solution added with certain sulfur-containing organic acid 5 in a salt form is coated onto the ink receiving layer 6 and the resulting coating layer is dried. In this manner, an inkjet recording medium is obtained in which a diffusible certain sulfur-containing organic acid is distributed in the ink receiving layer illustrated in FIG. 5H.

Figure 6A:
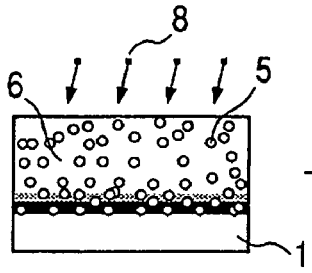
FIGS. 6A, 6B, 6C and 6D are diagrams which illustrate the yellowing prevention mechanism for the recording medium according to the present invention.
Figure 6B:
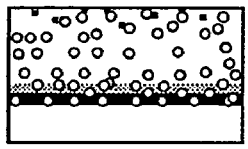
Figure 6C:
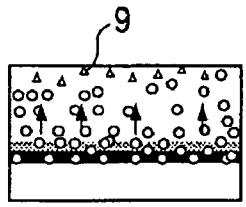
Figure 6D:
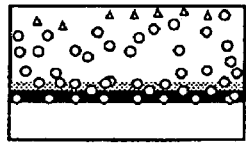

In a recording medium obtained by the method explained using FIGS. 5A to 5H, although a relatively large quantity of the certain sulfur-containing organic acid is present in the hydrated alumina agglomerate layer 7 (region illustrated by FIG. 5E), compared with method (2), the certain sulfur-containing organic acid is present throughout the entire ink receiving layer. The yellowing prevention performance in such a recording medium can be thought to be from the action schematically illustrated in FIGS. 6A to 6D. First, as illustrated in FIG. 6A, a yellowing causing substance 8 such as a phenolic antioxidant contained in a resin file holder for instance, adheres from the recording medium surface. If the yellowing causing substance 8 penetrates into the ink receiving layer as illustrated in FIG. 6B, the certain sulfur-containing organic acid salt 5 already contained in the ink receiving layer 6 reacts with this, and changes the yellowing causing substance to form an achromatized reaction product 9. Further, since the certain sulfur-containing organic acid salt 5 is contained in the ink receiving layer in a manner such that it is diffusible (movable) through the ink receiving layer, as illustrated in FIGS. 6C and 6D, unreacted certain sulfur-containing organic acid salt 5 diffuses in the region wherein the certain sulfur-containing organic acid 5 was consumed in decolorization in order to move the concentration gradient, which has formed between the region wherein the certain sulfur-containing organic acid 5 was consumed in decolorization and the region containing the certain sulfur-containing organic acid, closer to equilibrium. This mechanism leads to the inactivation of yellowing causing substances which were unable to be inactivated in FIG. 6B, whereby the yellowing causing substances are supplied to the adhering recording surface vicinity, thus maintaining the yellowing prevention effects.

The coating solution used in step C is a solution in which a salt of a sulfinic acid compound or a salt of a thiosulfonic acid compound acid has been dissolved in a solvent. Although the solvent can be selected so as to match the used certain sulfur-containing organic acid, preferably an aqueous solution of the sulfinic acid compound salt or thiosulfonic acid compound salt is used.

In step C, if a high-concentration certain sulfur-containing organic acid salt solution is used as a result of a salt of the certain sulfur-containing organic acid being supplied to the ink receiving layer surface, the salt concentration of the certain sulfur-containing organic acid rises, whereby a drop in printing quality, such as a drop in printing density, is more susceptible to occur. Therefore, to obtain good printing density, a coating solution wherein the salt concentration of the certain sulfur-containing organic acid is adjusted to 10% by mass or less is preferable, and especially preferable is a solution adjusted to 1% by mass or more to 8% by mass or less.

Further, the sulfur-containing compound concentration in the of 20 μm in a depth direction from the surface of the receiving layer which affects printing quality, i.e. the ink fixing layer, depends on the sulfur-containing compound concentration in the overcoating solution. Thus, when adding the sulfur-containing compound in an excess amount in step 2 of the present method, even if the organic acid concentration in the ink fixing layer rises to a level which affects printing quality, by adjusting the printing conditions of step C, for instance adjusting the salt concentration of the sulfur-containing organic acid in the overcoating solution, the diffusible sulfur-containing compound content in the receiving layer surface vicinity can be adjusted to an optimal value in terms of printing quality, thereby enabling yellowing prevention and printing quality to be simultaneously achieved.

The coating solution used in step C is a solution in which the above-described certain sulfur-containing organic acid and the certain sulfur-containing organic acid in a salt form are both dissolved. The ratio of cations with respect to the certain sulfur-containing organic acid in the coating solution is preferably 1.0 or greater. The solvent used to dissolve the above-described organic acid and the salt-formable cations is acceptable as long as it can dissolve the organic acid salt. Preferable examples include, but are not limited to, ion-exchange water, methanol, ethanol or the like, and more preferable is ion-exchange water. In terms of increasing production efficiency it is preferable to employ a coating solution wherein a mixed solvent, which combines a plurality of water-based and solvent-based solvents, is used to simultaneously dissolve the organic acid salt and a below-described other additive such as a hindered amine. While the pH of the coating solution in which the organic acid salt has been dissolved in a solvent is not limited, from 4.0 or more to 11.0 or less is preferable. More preferable is from 6.0 or more to 10 or less.

Support

Although the support used in the present invention is not particularly limited, either of a non-water-absorbent support made from a transparent material such as plastic, or a water-absorbent support made from a non-transparent material such as paper or the like may be used. However, since the duration of yellowing prevention performance depends on the total amount of the certain sulfur-containing organic acid contained in the recording medium, a water-absorbent support which can retain the certain sulfur-containing organic acid without affecting printing quality is preferable.

Especially preferable is a water-absorbent support which has a sulfinic acid compound and/or a thiosulfonic acid compound in the water-absorbent support, because such a support possesses yellowing prevention and suppresses crack formation during receiving layer formation.

A method for adding a sulfinic acid compound and/or thiosulfonic acid compound into a water-absorbent support can coat a dissolved solution of the sulfur-containing compound, or, can immerse the water-absorbent support in such a dissolved solution.

It is preferable to use a non-water-absorbent support made from a transparent material or a high-gloss non-transparent non-water-absorbent support when trying to harness transparency of the ink receiving layer which receives and fixes a pigment or other such colorant. If the surface of the recording medium is subjected to a casting step to form a glossy surface, a fiber support, that is, a water-absorbent support made from paper, is preferable, since water and solvent components evaporate from the substrate back surface. Examples of the water-absorbent support made from paper include a support whose base paper has been subjected to a size press of starch, polyvinyl alcohol or the like, or coated paper, such as art paper, coated paper, or cast-coated paper which is provided with a coating layer on a base paper.

If paper is used as a water-absorbent support, it is preferable that a thick coating layer which completely covers the cellulose pulp fibers or formation of the paper (base paper) is provided as an undercoat layer of the ink receiving layer. If not covered, uneven coating (lined defects etc.) is likely to occur in the fibers or formation during coating of the ink receiving layer. Since in the ink receiving layer, or the ink receiving layer surface vicinity or surface, cellulose pulp is present, it can become difficult to obtain a good and even cast surface, i.e., a high-gloss surface in a photographic style, even if the recording medium is subjected to a casting treatment. To cover the cellulose pulp of a water-absorbent support made from paper, the coating layer dry coating amount is preferably 10 $g/m^2$ or more, and more preferably 15 $g/m^2$ or more.

If a water-absorbent support made from paper is used, it is preferable to set the Stockigt sizing degree to between 100 seconds or more and 400 seconds or less, and the Beck smoothness to between 100 seconds or more and 500 seconds or less. Further, to attain a recording medium having the texture and high-quality feel of a silver halide photograph, it is preferable to set the paper water-absorbent support basis weight to from 160 $g/m^2$ or more to 230 $g/m^2$ or less and the Gurley stiffness (J. Tappi No. 40, machine direction) to from 7 N or more to 15 N or less.

Ink Receiving Layer

The hydrated alumina-containing coating solution comprises at least hydrated alumina and a binder, and as required, a crosslinking agent. During preparation of the coating solution for the ink receiving layer it is preferable to mix at least one selected from the group consisting of boric acid and borate with the hydrated alumina, and employ a mixing apparatus which uses a coating solution wherein the resulting mixed solution is mixed with aqueous polyvinyl alcohol sevving as the binder just before coating. If carried out in this way, the rise over time in coating solution viscosity and gelation which take place during the production steps can be lowered, whereby production efficiency can be increased. The solid content concentration of the hydrated alumina in the hydrated alumina dispersed solution used above is preferably from 10% by weight or more to 30% by weight or less. If this range is exceeded, the viscosity of the hydrated alumina dispersed solution increases, thereby increasing the viscosity of the ink receiving layer, which can cause problems with coatability.

Other additives which may be incorporated appropriately as required into the below-described undercoat layer and the above-described ink receiving layer include a pigment dispersant, a thickener, a fluidity modifier, a defoamer, a foam inhibitor, a mold lubricant, a penetrant, a coloring pigment, a coloring dye, a fluorescent whitener, an ultraviolet absorber, an antioxidant, a preservative, an anti-mildew agent, an anti-hydration agent and a pigment fixing agent.

A preferable binder in the present invention is a water-based resin, and a polyvinyl alcohol is especially preferable. Preferable examples of a polyvinyl alcohol include a polyvinyl alcohol having a degree of saponification of from 70% or more to 100% or less. In addition, the polyvinyl alcohol content is preferably set to between 5% by weight or more to 20% by weight or less of the hydrated alumina.

Preferable examples of a crosslinking agent which can be used in the present invention include agents which can cause a crosslinking reaction with the above-described binder for curing. Boron compounds are preferable for crosslinking with a polyvinyl alcohol in particular. Examples of such boron compounds include, for example, borax, boric acid, borates (e.g. orthoborate, $InBO_3$, $ScBO_3$, $YBO_3$, $LaBO_3$, $Mg_3(BO_3)_2$, $CO_3(BO_3)_2$, diborates (e.g., $Mg_2B_2O_5$ and $Co_2B_2O_5$), metaborate (e.g. $LiBO_2$, $Ca(BO_2)_2$, $NaBO_2$, $KBO_2$), tetraborates (e.g. $Na_2B_4O_7.10H_2O$), pentaborates (e.g. $KB_5O_8.4H_2O$, $Ca_2B_6O_{11}.7H_2O$, $CsB_5O_5$) and the like. Of these, from the point of being able to rapidly cause a crosslinking reaction, borax, boric acid and borate are preferable, while from the point of stability over time of the coating solution and suppression effects on crack formation, the use of boric acid is preferable. The amount to be used of such substance is preferably a boric acid solid content in the range of 1.0 to 15.0% by weight of the polyvinyl alcohol in the ink receiving layer.

Once the certain sulfur-containing organic acid-containing ink receiving layer has been formed on the support, a glossy surface can be formed by a casting method on the ink receiving layer surface. This production method will now be described. A casting method fixedly presses an ink receiving layer, which is in a moist state or a state possessing flexibility, onto a heated specular surface drum (casting drum), dries the fixedly pressed layer, and copies the specular surface onto the ink receiving layer surface. Representative examples of a casting method include the three methods of direct method, rewetting method (indirect method) and solidification method. Although any of these casting methods can be employed, a wet-casting method is preferable, because this method guarantees the effects of good diffusion of the certain sulfur-containing organic acid into the ink receiving layer, as a result of the certain sulfur-containing organic acid added into the ink receiving layer in the above-described step supplying moisture to the ink receiving layer. Using such a wet-casting method is also more preferable as high-gloss characteristics can be obtained for the ink receiving layer surface, and yellowing prevention effects can be even further improved.

Coating of the respective coating solutions in the ink receiving layer and surface treatment steps can be carried out by appropriate selection from among various coating apparatuses so that a correct coating amount is coated, such as, for example, a blade coater, roll coater, air knife coater, bar coater, rod blade coater, curtain coater, gravure coater, a coater using an extrusion system, a coater using a slide hopper system, a size press and the like. The coating can be carried out on-machine or off-machine. For the purpose of coating solution viscosity adjustment or the like, during coating the coating solution may be heated or the coating head may be heated. The post-coating drying can be carried out by appropriately selecting a hot-air dryer, such as a linear tunnel dryer, an arch dryer, an air-loop dryer, and a sine-curve air float dryer, or a dryer which employs infrared rays, a thermal dryer or microwaves.

To attain the object and effects of high ink absorption properties and high fixing properties and the like, the pore physical properties preferably satisfy the below conditions. First, the pore volume of the ink receiving layer is preferably in the range of from 0.1 $cm^3$ or more to 1.0 $cm^3$ or less. That is, if the pore volume is less than the above range, adequate ink absorption properties cannot be attained, so that the ink receiving layer has poor ink absorption properties. On occasion, ink may overflow, whereby there is a risk of bleeding onto the image. Further, if the above range is exceeded, there is a tendency for cracks and powder omission to form more easily in the ink receiving layer. Further, the BET specific surface area of the ink receiving layer is preferably between 20 to 450 $m^2/g$. If the BET specific surface area is less than this range, sufficient gloss may not be attained, and since haze increases (due to a drop in transparency), there is a risk of a white mist being seen in the image itself. A BET specific surface area less than this range is also undesirable because there is a risk of a drop in the adherence of the dye in the ink. On the other hand, exceeding the above range is not preferable, because cracks are more easily formed in the ink receiving layer. The pore volume and BET specific surface area values can be determined by nitrogen adsorption-desorption.

The ink receiving layer dry coating amount is preferably set to be between 30 and 50 $g/m^2$. Below this range is not preferable, especially, when used in a printer which adds a plurality of pale color inks as well as black ink to a cyan, magenta and yellow three-color ink, because adequate absorbing properties cannot be attained; namely, ink may overflow, whereby bleeding can occur and ink dye diffuses as far as the substrate, which can cause a drop in printing quality. On the other hand, if this range is exceeded, there is risk that crack formation cannot be completely suppressed. In addition, 30 $g/m^2$ or more is preferable because an ink receiving layer which exhibits adequate ink absorption properties can be attained, and 50 $g/m^2$ or less is preferable, since coating unevenness of the ink receiving layer does not occur as easily, whereby a stable and thick ink receiving layer can be produced.

A colorant degradation prevention agent can also be added into the inkjet recording medium according to the present invention. A colorant degradation prevention agent is a compound which protects the dye from factors which would degrade the dye such as gases and light when present together with a dye in the ink receiving layer, and increases the weatherability of a dye. General examples include, but are not limited to, hindered amine-based compounds, hindered phenolic compounds, benzophenone-based compounds, benzotriazole-based compounds, thiourea-based compounds, thiuram-based compounds, phosphite-based compounds and the like. Hindered amine compounds can be especially preferably used.

A preferable content of a hindered amine compound in the ink receiving layer is within the range of from 0.5% by weight or more to 10% by weight or less of the pigment solid content. By setting the content to such lower limit or greater, sufficient fading suppression effects can be obtained. By setting the content to such higher limit or less, a drop in ink absorption properties can be prevented.

It is preferable to add the adjusting solution in which the colorant degradation prevention agent according to the present invention is dissolved in a solvent by overcoating onto the above-described post-formation receiving layer. The solvent for dissolving the colorant degradation prevention agent is acceptable as long as it can dissolve the colorant degradation prevention agent, so that a variety of solvents can be employed. Examples of organic solvents include, but are not limited to, esters such as ethyl acetate, butyl acetate and the like, ketones such as methylisobutyl ketone, methylethyl ketone, acetone and the like, ethers such as diethyl ether, ethylmethyl ether and the like, and alcohols such as isopropanol, methanol, ethanol and the like. In addition, the certain sulfur-containing organic acid salt can be dissolved in the overcoating solution which contains the colorant degradation prevention agent, to thereby incorporate the certain sulfur-containing organic acid into the receiving layer in the overcoating step. A mixed solvent in which a plurality of solvents are used can be employed in the dissolving of the colorant degradation prevention agent and the certain sulfur-containing organic acid salt.

According to the production method of the present invention as described above, a certain sulfur-containing organic acid which is diffusible in an ink receiving layer can be made to be present in a salt form or a dissociated state, without being electrically bonded to hydrated alumina.

EXAMPLES

The present invention will now be described in further detail with reference to the below Examples and Comparative Examples. However, the present invention is not to be limited to what is disclosed therein. First, the measurement techniques and evaluation methods for the various physical property values employed in the present invention will be described.

Distribution Storage

A method was employed which carried out storage under storage conditions equivalent to a storage environment corresponding to the period (distribution period) from once a recording medium is produced until the product is delivered to the retailer. These distribution conditions correspond to conditions equivalent to transportation to Amsterdam via ocean transport after production in Japan. The storage method was to place the recording medium in a PET film container, and store for 10 days in a 50° C. and 80% R.H. environment.

White-Background Yellowing Evaluation During File Holder Storage

The evaluation method comprised keeping a 50 mm×80 mm unprinted test sample in a resin file holder (Name Card Holder, manufactured by Kokuyo Co., Ltd.), wherein 50 mm×10 mm of the test sample was made to stick out from the resin file holder, and storing for 3 months at room temperature.

The white-background yellowing evaluation during file holder storage was performed on the white portion of the test sample by visually evaluating the 50 mm×10 mm portion which was sticking out from the resin file holder A: No yellowing. Good level where no difference could be seen compared with the pre-storage white-background.

B: Compared with the pre-storage white-background, a level of yellowing confirmed which would still allow usage.

C: Yellowing confirmed in the peripheral portions of the test sample. A level which would prevent an image having white edges from being practically used.

D: Extensive yellowing. Level not suitable for practical use.

White-Background Yellowing Evaluation During BHT Exposure

The evaluation method comprised keeping a 25 mm×200 mm unprinted test sample in a sample test bottle (27 mm mouth diameter, 120 mm depth) which contained 5 g of 2,6-di-t-butyl-p-methylphenol (BHT), wherein the 80 mm of the test sample was made to stick out from the sample test bottle, and storing at 50° C. for 120 hours and 240 hours. These storage conditions were accelerated degradation test conditions, wherein the storage at 50° C. for 120 hours was equivalent to room temperature storage for 6 months in a resin file folder, and the 240 hours storage was equivalent to 1 year.

At this point, the white-background yellowing evaluation of during file holder storage was conducted by measuring the 50 mm×10 mm portion which was sticking out from the resin file holder at the white-background areas of the test sample with a spectrophotometer•spectrolino (manufactured by Gretag Macbeth). White-background yellowing was evaluated by using the difference in concentration between the obtained results and white-background concentration prior to storage.

White-background yellowing level ($\Delta b^*$)=pre-storage $b^*$−post-storage $b^*$ A: $\Delta b^* \leqq 2$ No yellowing apparent by visual observation. Good level.

B: $2 < \Delta b^* \leqq 3$ Level at which yellowing by visual observation causes no noticeable problems.

C: $3 < \Delta b^* \leqq 6$ Yellowing apparent by visual observation. Level which can still be used for practical use.

D: $\Delta b^* > 6$ Extensive yellowing. Level not suitable for practical use.

Printing Density Evaluation

Using a photo-printer (product name: PIXUS 950i, manufactured by Canon Inc.) employing an inkjet system, the recording surface of each of the above-described recording media were printed with 100% duty solid batches of black, cyan, magenta and yellow. After storage in a 25° C. 50% R.H. environment for 3 days, colorimetry measurement was carried out using a spectrophotometer•spectrolino (manufactured by Gretag Macbeth) and the OD values were evaluated.

A: OD value of 2.20 or more. Extremely good gray scale reproducibility of the high density areas. High practical use.

B: OD value of 2.10 or more, and less than 2.20. Although gray scale reproducibility of the high density areas somewhat inferior to that of A, no problems for practical use.

C: OD value of 2.00 or more, and less than 2.10. Although gray scale reproducibility of the high density areas is poor, can still be practically used.

D: OD value of 1.90 or more, and less than 2.00. Gray scale reproducibility of the high density areas very poor and printing density thin. Cannot be used practically.

Evaluation of Ink Absorption Properties

Using a photo-printer (product name: PIXUS 950i, manufactured by Canon Inc.) employing an inkjet system, the recording surface of each of the above-described recording media was applied with the secondary color green, wherein the applied amounts were varied from 100% to 240% in 20% increments, whereby the coated amount where no beading occurred was visually evaluated.

A: Even at a 140% or more applied amount, no beading occurred. Good level for practical use.

B: No beading at an applied amount of between 120% or more and less than 140%. No problems for practical use.

C: No beading at an applied amount of between 100% or more and less than 120%. Can be put into practical use.

D: Although no beading at an applied amount of less than 100%, would be difficult to put into practical use.

Evaluation of Coating Suitability (Cracks)

Recording media (A4 size) which had undergone ink receiving layer formation were visually evaluated for receiving layer surface cracks.

A: Less than 6 cracks. Good level for practical use.

B: Six or more cracks, but less than 10. Level difficult for practical use.

C: Ten or more cracks. Cannot be practically used.

Overall Evaluation

Overall evaluation was conducted in the following manner.

E: No B ranks for any of the evaluated categories, high practical use.

M: While some evaluations received a B rank, no C rank in any of the categories. Can be put into practical use.

P: At least one evaluated category received a C rank. Difficult to put into practical use.

Example 1

Support Preparation

First, a support was produced in accordance with the following. A slurry consisting of 80 parts by weight of laubholz bleached kraft pulp (LBKP) having a 450 ml CSF (Canadian Standard Freeness) freeness and 20 parts by weight of nadelholz bleached kraft pulp (NBKP) having a 480 ml CSF freeness was charged with 0.60 parts by weight of cationized starch, 10 parts by weight of heavy calcium carbonate, 15 parts by weight of light calcium carbonate, 0.10 parts by weight of alkylketenedimer and 0.03 parts by weight of cationic polyacrylamide. The resulting mixture was adjusted, and then made into paper using a Fourdrinier paper machine. The formed paper was subjected to a three stage wet press, and the resulting product was dried using a multi-barreled dryer. Next, the dried product was impregnated using a size press with aqueous oxidized starch such that the solid content was 1.0 g/m$^2$. The impregnated product was dried, then finished with a machine calendar, to thereby obtain a support having a basis weight of 155 g/m$^2$, a Stockigt sizing degree of 100 seconds, air permeability of 50 seconds, a Beck smoothness of 30 seconds and a Gurley stiffness of 11.0 mN.

Next, an undercoat layer was formed in the following manner on the above-obtained support. First, as the coating solution to be used in forming the undercoat layer, a 70% by weight solid content concentration slurry consisting of 100 parts by weight of a filler consisting of kaolin (Ultra White 90, manufactured by Engelhard Corporation)/zinc oxide/hydrated alumina in a weight ratio of 65/10/25 and 0.1 parts by weight of a commercially-available polyacrylate dispersant was charged with 7 parts by weight of a commercially-available styrene-butadiene latex. The resulting mixture was adjusted to give a solid content of 60% by weight, whereby a composition was obtained. Next, this composition was coated onto both sides of the support using a blade coater such that the dry coating amount would be 15.0 g/m$^2$. The coated composition was then dried and finished with a machine calendar (line pressure of 150 kgf/cm), to thereby obtain a support, provided with an undercoat layer, having a basis weight of 185 g/m$^2$, a Stockigt sizing degree of 300 seconds, air permeability of 3,000 seconds, a Beck smoothness of 200 seconds and a Gurley stiffness of 11.5 mN. The whiteness of the undercoat layer-comprising support was measured for each of 5 samples cut to A4 size, and taken as the average value. The results showed L*: 95, a*: 0, b*: −2 (measured as JIS Z 8729 hue).

Surface Treatment Step

The above-obtained undercoat layer was subjected to a surface treatment consisting of the below steps. First, a pre-coating solution of the below composition was heated to 30° C., and coated at 30 meters per minute using an air knife coater so that the wet coating amount would be 16 g/m$^2$ (when dried the coated amount would be 0.8 g/m$^2$).

Pre-Coating Solution

Sodium tetraborate: 5 g

Isopropanol: 0.15 g

Adjusted to a total amount of 100 g by adding ion-exchange water

Coating step of a coating solution comprising hydrated alumina, a binder and a cross-linking agent:

Step B

Next, although an ink receiving layer was formed, after the above surface treatment step coating, that is, immediately after the coating solution was impregnated into the undercoat layer, the ink receiving layer was formed on the undercoat layer. The coating solution and coating method employed during this ink receiving layer formation are as described below.

As hydrated alumina A, Disperal HP 13 (manufactured by Sasol Chemical Industries Ltd.) was dispersed in water (preferably, pure water as a dirt countermeasure for the alumina) such that the solid content was 5% by weight. The resulting solution was charged with hydrochloric acid to adjust to a pH value of 4, and then stirred for a while. The temperature of this dispersed solution was then raised to 95° C. while stirring, and the solution was kept at this temperature for 4 hours. While maintaining this temperature, the solution pH was adjusted to a value of 10 using caustic soda. The solution was stirred for 10 hours, after which the dispersed solution temperature was returned to room temperature and the pH was adjusted to a pH value of 7 to 8. The solution was subjected to a desalting treatment, and the desalted solution was charged with acetic acid. The resulting solution was subjected to a deflocculation treatment, whereby a colloidal sol was obtained. This colloidal sol was dried, and the resulting hydrated alumina B was analyzed using X-ray diffraction. The results showed that this compound exhibited a boehmite structure (pseudoboehmite). The BET specific surface area was 143 g/m$^2$ and pore volume was 0.8 cm$^3$/g. Observation using an electron microscope showed that the compound was planar.

Further, the polyvinyl alcohol PVA 117 (manufactured by Kuraray Co., Ltd.) was dissolved in ion-exchange water, whereby an aqueous solution having a solid content of 9% by weight was obtained. The above-prepared hydrated alumina B colloidal sol was concentrated to form a 22.5% by weight dispersed solution. This solution was charged with aqueous 3% boric acid such that the solution contained 0.50% by weight calculated as boric acid solid content with respect to the solid content of the hydrated alumina B. Next, the obtained boric acid-containing hydrated alumina dispersed solution and the above-prepared aqueous polyvinyl alcohol solution were mixed using a static mixer so that the ratio between the hydrated alumina solid content and the polyvinyl alcohol solid content was 100:8. The mixture was then immediately used as the coating solution for the ink receiving layer, and coated at 30 meters per minute using a dye coater so that the dry coated amount would be 35 g/m$^2$. Drying was carried out at 170° C., whereby an ink receiving layer was formed.

Overcoating Step

Next, the below-described overcoating solution was coated at 30 meters per minute using a dye coater so that the wet coated amount would be 30 g/m$^2$. Drying was carried out at 120° C., whereby an ink receiving layer was formed.

Overcoating Solution Formulation

Compound II-1: 2.2 g

After diluting with ion-exchange water, the pH was adjusted to 5.0 using 0.05 N nitric acid. The total amount was adjusted to 100 g using ion-exchange water.

Underside Formation

Next, an underside layer was formed in the following manner on the undercoat layer which was on the surface of the support opposite to that provided with the ink receiving layer. As the hydrated alumina, Disperal HP 13/2 (manufactured by Sasol Chemical Industries Ltd.) was dispersed in water (preferably, pure water as a dirt countermeasure for the alumina) such that the solid content was 18% by weight. The dispersed solution was then subjected to centrifugal separation. This resulting dispersed solution and the same aqueous polyvinyl alcohol solution used in the formation of the ink receiving layer were mixed using a static mixer so that the ratio between the hydrated alumina solid content and the polyvinyl alcohol solid content was 100:9. The resulting mixture was then immediately coated at 35 meters per minute using a dye coater so that the dry coated amount would be 23 g/m$^2$. Drying was carried out at 170° C., whereby an ink receiving layer was formed.

Example 2

An ink receiving layer was formed in the same manner, except that the overcoating solution pH of Example 1 was adjusted to 6.0 using 0.05 N nitric acid, and then the total amount was adjusted to 100 g using ion-exchange water.

Example 3

An ink receiving layer was formed in the same manner, except that the overcoating solution pH of Example 1 was adjusted to 6.2 using 0.05 N nitric acid, and then the total amount was adjusted to 100 g using ion-exchange water.

Example 4

An ink receiving layer was formed in the same manner, except that the overcoating solution pH of Example 1 was adjusted to 7.3 using 0.05 N nitric acid, and then the total amount was adjusted to 100 g using ion-exchange water.

Example 5

An ink receiving layer was formed in the same manner, except that the overcoating solution pH of Example 1 was adjusted to 8.3 using 0.05 N nitric acid, and then the total amount was adjusted to 100 g using ion-exchange water.

Example 6

An ink receiving layer was formed in the same manner, except that the added amount of the compound II-1 in the overcoating solution formulation of Example 2 was changed from 2.2 g to 0.55 g.

Example 7

An ink receiving layer was formed in the same manner, except that the added amount of the compound II-1 in the overcoating solution formulation of Example 2 was changed from 2.2 g to 1.1 g.

Example 8

An ink receiving layer was formed in the same manner, except that the added amount of the compound II-1 in the overcoating solution formulation of Example 2 was changed from 2.2 g to 1.65 g.

Example 9

An ink receiving layer was formed in the same manner, except that the added amount of the compound II-1 in the overcoating solution formulation of Example 2 was changed from 2.2 g to 8.8 g.

Example 10

An ink receiving layer was formed in the same manner, except that the added amount of the compound II-1 in the overcoating solution formulation of Example 2 was changed from 2.2 g to 13.2 g.

Example 11

An ink receiving layer was formed in the same manner, except that the added amount of the compound II-1 in the overcoating solution formulation of Example 2 was changed from 2.2 g to 17.6 g.

Example 12

An ink receiving layer was formed in the same manner, except that compound II-I of Example 2 was changed to compound II-2.

Example 13

An ink receiving layer was formed in the same manner, except that compound II-I of Example 2 was changed to compound I-1.

Example 14

An ink receiving layer was formed in the same manner, except that compound II-I of Example 2 was changed to compound 1-2.

Comparative Example 1

An ink receiving layer was formed in the same manner, except that the overcoating solution of Example 1 was changed to the below solution.

Overcoating Solution Composition p-toluenesulfinic acid: 2.2 g

Total amount adjusted to 100 g using ethanol

Comparative Example 2

An ink receiving layer was formed in the same manner, except that the overcoating solution of Example 1 was changed to the below solution.

Overcoating Solution Composition p-toluenesulfinic acid: 8.8 g

Total amount adjusted to 100 g using ethanol

Comparative Example 3

An ink receiving layer was formed in the same manner, except that the overcoating solution pH of Example 1 was adjusted to 3.0 using 0.05 N nitric acid, and then the total amount was adjusted to 100 g using ion-exchange water.

Subsequently, 0.05 N nitric acid was coated with a Mayer bar to adjust the surface and interior pH to 3.0.

Comparative Example 4

An ink receiving layer was formed in the same manner, except that the overcoating solution pH of Example 1 was adjusted to 4.2 using 0.05 N nitric acid, and then the total amount was adjusted to 100 g using ion-exchange water.

Subsequently, 0.05 N nitric acid was coated with a Mayer bar to adjust the surface and interior pH to 4.2.

Comparative Example 5

An ink receiving layer was formed in the same manner, except that the overcoating step of Example 1 was omitted. 0.05 N nitric acid was then coated with a Mayer bar to adjust the surface and interior pH to 4.2.

Comparative Example 6

After coating the below-described pre-coating solution onto the support in place of the pre-coating solution described in Example 1, the below-described coating solution B was coated at 30 meters per minute using a dye coater so that the dry coated amount would be 35 g/m$^2$ for the coating step (step B) coating solution which comprises hydrated alumina, a binder and a cross-linking agent. Drying was carried out at 170° C., whereby the ink receiving layer was formed. In this case, since the alumina agglomerated and solidified during coating solution B preparation, coating onto the support was impossible, whereby a receiving layer could not be formed.

Pre-Coating Solution

Sodium tetraborate: 5 g

Isopropanol: 0.15 g

Adjusted to a total amount of 100 g by adding ion-exchange water

Coating Solution B 444.44 g of the colloidal sol described in Example 1 was concentrated to form a 22.5% by weight dispersed solution 88.88 g of the polyvinyl alcohol PVA 117 (manufactured by Kuraray Co., Ltd.)

0.50 g of boric acid 4.00 g compound II-1

Comparative Example 7

After coating the below-described pre-coating solution onto the support in place of the pre-coating solution described in Example 1, the below-described coating solution B was coated at 30 meters per minute using a dye coater so that the dry coated amount would be 35 g/m$^2$ for the coating step (step B) coating solution which comprises hydrated alumina, a binder and a cross-linking agent. Drying was carried out at 170° C., whereby the ink receiving layer was formed.

Pre-Coating Solution

Sodium tetraborate: 5 g

Isopropanol: 0.15 g

Adjusted to a total amount of 100 g by adding ion-exchange water

Coating Solution B 444.44 g of the colloidal sol described in Example 1 was concentrated to form a 22.5% by weight dispersed solution 88.88 g of the polyvinyl alcohol PVA 117 (manufactured by Kuraray Co., Ltd.)

0.50 g of boric acid 0.40 g of compound II-1

Table 1 shows the results of evaluation of the white-background yellowing during file holder storage, printing density, ink bleeding, water resistance and external appearance of the inkjet recording media produced in Examples 1 to 14 and Comparative Example 1 to 7.

TABLE 1

| | pH | Total added amount of sulfur-containing organic acid in the medium (with respect to alumina wt. %) | File yellowing | Forced yellowing (120 hr) | Forced yellowing (240 hr) | Forced yellowing (post-distribution period) | Printing density | Ink absorption properties | Total evaluation |
|---|---|---|---|---|---|---|---|---|---|
| Ex. 1 | 5.0 to 5.4 | 2.6 | A | A | B | B | A | B | M |
| Ex. 2 | 6.0 to 6.2 | 2.6 | A | A | A | A | A | A | E |
| Ex. 3 | 6.2 to 6.6 | 2.6 | A | A | A | A | A | A | E |
| Ex. 4 | 7.3 to 7.5 | 2.6 | A | A | A | A | A | A | E |
| Ex. 5 | 8.3 to 8.5 | 2.6 | B | B | B | B | B | A | M |
| Ex. 6 | 6.2 to 6.6 | 0.6 | B | B | B | B | A | A | M |
| Ex. 7 | 6.2 to 6.6 | 1.3 | A | A | A | A | A | A | E |
| Ex. 8 | 6.2 to 6.6 | 1.9 | A | A | A | A | A | A | E |
| Ex. 9 | 6.2 to 6.6 | 10.3 | A | A | A | A | A. | A | E |
| Ex. 10 | 6.2 to 6.6 | 15.5 | A | A | A | A | B | B | M |
| Ex. 11 | 6.2 to 6.6 | 20.6 | A | A | A | A | B | B | M |
| Ex. 12 | 6.0 to 7.5 | 2.6 | A | A | A | A | A | A | E |
| Ex. 13 | 6.0 to 7.5 | 2.6 | A | A | A | A | A | A | E |
| Ex. 14 | 6.0 to 7.5 | 2.6 | A | A | A | A | A | A | E |
| Com. Ex. 1 | 4.2 | 2.6 | C | C | D | D | B | D | P |
| Com. Ex. 2 | 4.2 | 10.3 | C | C | C | D | B | D | P |
| Com. Ex. 3 | 3 | 2.6 | C | C | D | D | B | D | P |
| Com. Ex. 4 | 4.2 | 2.6 | C | C | C | D | B | D | P |
| Com. Ex. 5 | 4.2 | — | C | C | D | D | B | D | P |
| Com. Ex. 6 | 6.0 to 7.5 | 2.6 | — | — | — | — | — | — | P |
| Com. Ex. 7 | 6.0 to 7.5 | 0.3 | D | D | D | D | D | B | P |

Although Example 1 is at a level for practical use, Example 1 is inferior in long-term storage performance to Examples 2, 3 and 4, which exhibit preferable conditions for the present invention by setting the receiving layer surface and interior pH to be relatively low, thus causing a part of the compound II-1 to be present in the receiving layer as an acid. Further, although Example 5 is at a level for practical use, Example 5 is inferior in yellowing prevention performance to the compound II-1 Examples 2, 3 and 4, which exhibit preferable conditions for the present invention by setting the receiving layer surface and interior pH to be relatively high. From these facts, it can be said that for the present invention an ink receiving layer surface and interior pH of 6.0 or more to 7.5 or less is particularly preferable.

On the other hand, although Example 6 is at a level for practical use, it is worse than Example 2 in yellowing prevention performance. Further, although Examples 10 and 11 are at a level for practical use, a drop in printing density occurred, which is thought to be due to the increased concentration of compound II-1 in the recording medium. This printing density drop is thought to have occurred due to the ink receiving layer transparency decreasing as a result of the compound II-1 being added in excess to a level which normally would not be used. Putting it the other way, this illustrates that the diffusion effects of the present invention can still be obtained even if a large quantity is added, and at the same time, illustrates that a practical use level can be attained by adding so that the ink absorption properties are set within a certain range. Therefore, it can be said that making the certain sulfur-containing organic acid to be present in the range of 1.0% by mass or more and 13% by mass or less of the hydrated alumina calculated as alumina is particularly preferable.

The mass % of the diffusible certain sulfur-containing organic acid with respect to the hydrated alumina in the ink recording medium and the mass % of the certain sulfur-containing organic acid with respect to the hydrated alumina in the ink fixing layer were found by measuring the mass % of the certain sulfur-containing organic acid with respect to the alumina amount in the ink receiving layer based on the measured results of the abundance ratio of alumina and sulfur using TOF-SIMS. The ink receiving layer surface and interior pH measurement obtained above was conducted in accordance with method A (coating method) among the surface and interior pH measurements prescribed by the Japan Technical Association of the Pulp & Paper Industry (J.TAPPI). Measurement of the ink receiving layer surface and interior pH was conducted using a paper surface pH measuring kit (MPC model) manufactured by Kyoritsu Chemical-Check Lab., Corp., suitable for the above-describe method A. The interior pH of the ink receiving layer was confirmed by, after the surface and interior pH measurement by the above-described method, using a microscope to ascertain a cross-section prepared using a microtome, and then ascertaining that the ink receiving layer interior pH was the same as the surface and interior pH according to whether the coating solution of the test kit had completely penetrated the ink receiving layer and whether the coating solution was evenly colored without any color unevenness in the range from the recording surface to the support.

Example 15

A support was produced in the same manner as in Example 1.

Surface Treatment: Step A2

The above-obtained support undercoat layer was subjected to a surface treatment consisting of the below steps. First, a pre-coating solution of the below composition was heated to 30° C., and coated at 30 meters per minute using an air knife coater so that the wet coating amount would be 16 g/m$^2$ (when dried the coated amount would be 0.8 g/m$^2$).

Pre-Coating Solution

Sodium tetraborate: 5 g

Compound (II-1): 4.1 g

Isopropanol: 0.15 g

The respective the above-described components were mixed with ion-exchange water to form a 90 g total amount. This solution was adjusted to a pH of 9.5 using 0.05 N nitric acid and 0.05 N sodium hydroxide, and then the total amount was adjusted to 100 g by adding ion-exchange water.

Coating step of a coating solution comprising hydrated alumina, a binder and a cross-linking agent:

Step B

Next, although an ink receiving layer was formed, 13 seconds after the above surface treatment step coating, that is, immediately after the coating solution was impregnated onto the undercoat layer, the ink receiving layer was formed on the undercoat layer. The coating solution and coating method employed during this ink receiving layer formation are the same as in Example 1.

Underside Formation

Next, an underside layer was formed in the same manner as in Example 1.

Example 16

An ink receiving layer was formed in the same manner, except that the pre-coating solution of Example 15 was changed to the below composition, and coating was carried out by maintaining the solution temperature at 30° C.

Pre-Coating Solution

Sodium tetraborate: 5 g

Compound (II-1): 8.3 g

Isopropanol: 0.15 g

The respective the above-described components were mixed with ion-exchange water to form a 90 g total amount. This solution was adjusted to a pH of 9.5 using 0.05 N nitric acid and 0.05 N sodium hydroxide, and then the total amount was adjusted to 100 g by adding ion-exchange water.

Example 17

An ink receiving layer was formed in the same manner, except that the pre-coating solution of Example 15 was changed to the below composition, and coating was carried out by repeatedly coating and drying three times with the solution temperature maintained at 40° C.

Pre-Coating Solution

Sodium tetraborate: 1.7 g

Compound (II-1): 8.3 g

Isopropanol: 0.15 g

The respective the above-described components were mixed with ion-exchange water to form a 90 g total amount. This solution was adjusted to a pH of 9.5 using 0.05 N nitric acid and 0.05 N sodium hydroxide, and then the total amount was adjusted to 100 g by adding ion-exchange water.

Example 18

An ink receiving layer was formed in the same manner, except that the pre-coating solution of Example 15 was changed to the below composition, and coating was carried out by repeatedly coating and drying four times with the solution temperature maintained at 40° C.

Pre-Coating Solution

Sodium tetraborate: 1.25 g

Compound (II-1): 8.25 g

Isopropanol: 0.15 g

The respective the above-described components were mixed with ion-exchange water to form a 90 g total amount. This solution was adjusted to a pH of 9.5 using 0.05 N nitric acid and 0.05 N sodium hydroxide, and then the total amount was adjusted to 100 g by adding ion-exchange water.

Example 19

An ink receiving layer was formed in the same manner, except that the support of Example 16 was changed to a white PET film.

Example 20

An ink receiving layer was formed in the same manner, except that the pre-coating solution of Example 15 was changed to the below pre-coating solution and a dissolved solution of a sulfur-containing organic acid salt, wherein the pre-coating solution was coated once the dissolved solution of the sulfur-containing organic acid salt had been coated.

Pre-Coating Solution

Sodium tetraborate: 5 g

Isopropanol: 0.15 g

Adjusted to a total amount of 100 g by adding ion-exchange water

Dissolved solution of the sulfur-containing organic acid salt

Compound (II-1): 8.3 g

Ion-exchange water: 90 g

The solution was adjusted to a pH of 9.5 using 0.05 N nitric acid and 0.05 N sodium hydroxide, and then the total amount was adjusted to 100 g by adding ion-exchange water.

Example 21

An ink receiving layer was formed in the same manner, except that the pre-coating solution of Example 15 was changed to the below pre-coating solution and a dissolved solution of a sulfur-containing organic acid salt, wherein the dissolved solution of the sulfur-containing organic acid salt was coated once the pre-coating solution had been coated.

Pre-Coating Solution

Sodium tetraborate: 5 g

Isopropanol: 0.15 g

Adjusted to a total amount of 100 g by adding ion-exchange water

Dissolved solution of the sulfur-containing organic acid salt

Compound (II-1): 8.3 g

Ion-exchange water: 90 g

The solution was adjusted to a pH of 9.5 using 0.05 N nitric acid and 0.05 N sodium hydroxide, and then the total amount was adjusted to 100 g by adding ion-exchange water.

Example 22

An ink receiving layer was formed in the same manner, except that the support of Example 16 was immersed for 30 seconds in a solution of compound II-1 (5% by weight), whereby the support incorporated 1.25 g/m$^2$ of compound II-1, and the pre-coating solution was changed to the below composition.

Pre-Coating Solution

Sodium tetraborate: 5 g

Isopropanol: 0.15 g

The respective the above-described components were mixed with ion-exchange water to form a 90 g total amount. This solution was adjusted to a pH of 9.5 using 0.05 N nitric acid and 0.05 N sodium hydroxide, and then the total amount was adjusted to 100 g by adding ion-exchange water.

Example 23

The receiving layer obtained in Example 17 was coated with the below-described overcoating solution at 30 meters per minute using a dye coater so that the wet coated amount would be 30 g/m$^2$. Drying was carried out at 120° C., whereby an ink receiving layer was formed.

Overcoating Solution Formulation

Compound II-1: 4.4 g

After diluting with ion-exchange water, the pH was adjusted to 6.0 using 0.05 N nitric acid. The total amount was adjusted to 100 g using ion-exchange water.

Example 24

An ink receiving layer was formed in the same manner, except that the support of Example 16 was immersed for 90 seconds in a solution of compound II-1 (10% by weight), whereby the support incorporated 6.7 g/m$^2$ of compound II-1, and the pre-coating solution was changed to the below composition.

Pre-Coating Solution

Sodium tetraborate: 5 g

Isopropanol: 0.15 g

The respective the above-described components were mixed with ion-exchange water to form a 90 g total amount. This solution was adjusted to a pH of 9.5 using 0.05 N nitric acid and 0.05 N sodium hydroxide, and then the total amount was adjusted to 100 g by adding ion-exchange water.

Example 25

An ink receiving layer was formed in the same manner, except that the pre-coating solution of Example 15 was changed to the below composition.

Pre-Coating Solution

Sodium tetraborate: 5 g

Compound II-1: 8.3 g

Isopropanol: 0.15 g

The respective the above-described components were mixed with ion-exchange water to form a 90 g total amount. This solution was adjusted to a pH of 5.0 using 0.05 N nitric acid and 0.05 N sodium hydroxide, and then the total amount was adjusted to 100 g by adding ion-exchange water.

Example 26

An ink receiving layer was formed in the same manner, except that the pre-coating solution of Example 15 was changed to the below composition.

Pre-Coating Solution

Sodium tetraborate: 5 g

Compound II-1: 8.3 g

Isopropanol: 0.15 g

The respective the above-described components were mixed with ion-exchange water to form a 90 g total amount. This solution was adjusted to a pH of 7.2 using 0.05 N nitric acid and 0.05 N sodium hydroxide, and then the total amount was adjusted to 100 g by adding ion-exchange water.

Example 27

An ink receiving layer was formed in the same manner, except that the pre-coating solution of Example 15 was changed to the below composition.

Pre-Coating Solution

Sodium tetraborate: 5 g

Compound II-1: 8.3 g

Isopropanol: 0.15 g

The respective the above-described components were mixed with ion-exchange water to form a 90 g total amount. This solution was adjusted to a pH of 8.1 using 0.05 N nitric acid and 0.05 N sodium hydroxide, and then the total amount was adjusted to 100 g by adding ion-exchange water.

Example 28

An ink receiving layer was formed in the same manner, except that the compound II-1 of Example 15 was changed to compound I-1.

Example 29

An ink receiving layer was formed in the same manner, except that the compound II-1 of Example 15 was changed to compound II-2.

Comparative Example 8

The support of Example 15 was coated with the below-described pre-coating solution and the below-described overcoating solution. The coated support was dried at 120° C., and an ink receiving layer was formed on the dried support in the same manner as in Example 1. The ink receiving layer pH was then adjusted to 4.2 by coating with 0.05 N nitric acid.

Pre-Coating Solution

Sodium tetraborate: 5 g

Isopropanol: 0.15 g

The respective the above-described components were mixed with ion-exchange water to form a 90 g total amount. This solution was adjusted to a pH of 5.0 using 0.05 N nitric acid and 0.05 N sodium hydroxide, and then the total amount was adjusted to 100 g using ion-exchange water.

Overcoating Solution Composition p-toluenesulfinic acid: 0.6 g

Total amount adjusted to 100 g using ethanol

Comparative Example 9

An ink receiving layer was formed in the same manner as in Comparative Example 8, except that the overcoating layer was changed to the below-described overcoating layer. Once formed, the ink receiving layer pH was adjusted to 4.2 by coating with 0.05 N nitric acid.

Overcoating Solution Composition 4.4 g of p-toluenesulfinic acid was dissolved in ion-exchange water, and the total amount was adjusted to 90 g. The pH was then adjusted to 4.2 using 0.05 N nitric acid, after which the solution was adjusted to 100 g with ion-exchange water.

Comparative Example 10

An ink receiving layer was formed in the same manner as in Comparative Example 9, except that the overcoating layer was changed to the below-described overcoating layer. Once formed, the ink receiving layer pH was adjusted to 4.2 by coating 0.05 N nitric acid.

Overcoating Solution Composition 22.1 g of p-toluenesulfinic acid was dissolved in ion-exchange water, and the total amount was adjusted to 90 g. The pH was then adjusted to 4.2 using 0.05 N nitric acid, after which the solution was adjusted to 100 g with ion-exchange water.

Comparative Example 11

An ink receiving layer was formed in the same manner as in Example 15, except that the pre-coating layer was changed to that described below. Once formed, the ink receiving layer pH was adjusted to 4.2 by coating 0.05 N nitric acid.

Pre-Coating Solution

Sodium tetraborate: 5 g

Compound II-1: 4.1 g

Isopropanol: 0.15 g

Ion-exchange water was charged to a total amount of 90 g, after which the solution was adjusted to a pH of 3.8 using 0.05 N nitric acid and 0.05 N sodium hydroxide, and then the total amount was adjusted to 100 g by adding ion-exchange water.

Comparative Example 12

An ink receiving layer was formed in the same manner as in Example 18, except that the pre-coating layer was changed to the pre-coating solution described below. Once formed, the ink receiving layer pH was adjusted to 4.2 by coating with 0.05 N nitric acid.

Pre-Coating Solution

Sodium tetraborate: 1.25 g

Compound II-1: 8.25 g

Isopropanol: 0.15 g

The respective the above-described components were mixed with ion-exchange water to form a 90 g total amount. This solution was adjusted to a pH of 3.8 using 0.05 N nitric acid and 0.05 N sodium hydroxide, and then the total amount was adjusted to 100 g by adding ion-exchange water.

Table 2 shows the results of evaluation of the white-background yellowing during file holder storage, printing density, ink bleeding, water resistance and appearance of each of the obtained inkjet recording media. The weight % of the diffusible certain sulfur-containing organic acid with respect to the hydrated alumina in the ink recording medium and the weight % of the certain sulfur-containing organic acid with respect to the hydrated alumina in the ink fixing layer were found by measuring the weight % of the sulfur-containing organic acid with respect to the alumina amount in the ink receiving layer based on the measured results of the abundance ratio of alumina and sulfur using TOF-SIMS.

Measurement of the above-obtained ink receiving layer surface and interior pH was conducted in accordance with method A (coating method) among the surface and interior pH measurements prescribed by the Japan Technical Association of the Pulp & Paper Industry (J.TAPPI). Measurement of the ink receiving layer surface and interior pH was conducted using a paper surface pH measuring kit (MPC model) manufactured by Kyoritsu Chemical-Check Lab., Corp., suitable for the above-describe method A. The interior pH of the ink receiving layer was confirmed by, after the surface and interior pH measurement by the above-described method, using a microscope to ascertain a cross-section prepared using a microtome, and then confirming that the ink receiving layer interior pH was the same as the surface and interior pH according to whether the coating solution of the test kit had completely penetrated the ink receiving layer and whether the coating solution was evenly colored without any color unevenness in the range from the recording surface to the support.

Table 2 shows the results of evaluation of the white-background yellowing during file holder storage, printing density, ink absorption properties and cracks of each of the obtained inkjet recording media.

TABLE 2

| | Paper surface pH | Medium added amount (with respect to alumina wt. %) | Surface at 20μ (with respect to alumina wt. %) | Forced yellowing (240 hr) | Forced yellowing (post-distribution period) | Printing density | Ink absorption properties | Cracks |
|---|---|---|---|---|---|---|---|---|
| Ex. 15 | 6.0 to 6.4 | 2.6% | 0.8% | B | B | A | A | A |
| Ex. 16 | 6.0 to 6.4 | 5.1% | 1.5% | B | B | A | A | A |
| Ex. 17 | 6.0 to 6.4 | 15.4% | 4.6% | A | A | B | B | A |
| Ex. 18 | 6.0 to 6.4 | 20.5% | 6.2% | A | A | B | B | A |
| Ex. 19 | 6.0 to 6.4 | 5.1% | 1.5% | B | B | A | A | A |
| Ex. 20 | 6.0 to 6.4 | 5.1% | 1.5% | B | B | A | A | A |
| Ex. 21 | 6.0 to 6.4 | 5.1% | 1.5% | B | B | A | A | A |
| Ex. 22 | 6.0 to 6.4 | 5.1% | 1.3% | B | B | A | A | A |
| Ex. 23 | 6.0 to 6.4 | 20.5% | 1.0% | A | A | A | A | A |
| Ex. 24 | 6.0 to 6.4 | 30.8% | 0.5% | A | A | A | A | A |
| Ex. 25 | 5.0 to 5.4 | 5.1% | 1.5% | B | B | A | B | A |
| Ex. 26 | 7.1 to 7.5 | 5.1% | 1.5% | B | B | A | A | A |
| Ex. 27 | 8.1 to 8.5 | 5.1% | 1.5% | B | B | B | A | A |
| Ex. 28 | 6.0 to 6.4 | 2.6% | 0.8% | B | B | A | A | A |
| Ex. 29 | 6.0 to 6.4 | 2.6% | 0.8% | B | B | A | A | A |
| Com. Ex. 8 | 4.2 | 0.6% | 0.8% | D | D | C | C | B |
| Com. Ex. 9 | 4.2 | 5.1% | 3.8% | D | D | D | D | B |
| Com. Ex. 10 | 4.2 | 25.6% | 20.5% | C | C | D | D | B |
| Com. Ex. 11 | 4.2 | 2.6% | 0.1% | D | D | C | C | C |
| Com. Ex. 12 | 4.2 | 20.5% | 0.1% | D | D | C | C | C |

Although Example 25 is at a level for practical use, it shows a drop in ink absorption properties compared with Examples 15 and 26, which exhibit preferable conditions for the present invention by setting the receiving layer surface and interior pH to be relatively low, thus causing a part of the compound II-1 to be present in the receiving layer as an acid. Further, although Example 27 is at a level for practical use, a comparison with the compound II-1 Examples 16, 17 and 18 shows that Example 27 has a lower printing density, as a result of the receiving layer surface and interior pH being set relatively high. From these facts, it can be said that for the present invention an ink receiving layer surface and interior pH of 6.0 or more to 7.5 or less is particularly preferable.

From the technical concepts of the present invention, inactivation of BHT can be realized through the introduction of a diffusible sulfinic acid and thiosulfonic acid for articles having micropores which adsorb BHT. Consequently, long-term remarkable yellowing prevention effects can be attained. This fact means that applications of the present invention can be developed across a wide range of fields. The person skilled in the art would surely understand that the present invention can also be applied for a microporous body part other than that of hydrated alumina.

This application claims priorities from Japanese Patent Applications No. 2004-301819 filed Oct. 15, 2004 and No. 2004-336605 filed Nov. 19, 2004, which are hereby incorporated by reference herein.

What is claimed is:

1. An inkjet recording medium comprising an ink receiving layer as the microporous body part on a support, wherein the ink receiving layer comprises (a) at least one sulfur-containing organic acid selected from the group consisting of a diffusible sulfinic acid compound and a diffusible thiosulfonic acid compound, (b) hydrated alumina, and (c) a binder.

2. The inkjet recording medium according to claim 1, wherein the sulfur-containing organic acid is present in the amount from 1.0% by weight or more to 8% by weight or less of the hydrated alumina calculated as alumina in a part with a depth from the recording surface of 20 μm of the ink receiving layer.

3. The inkjet recording medium according to claim 1, wherein the ink receiving layer has a surface and interior pH from 5.0 or more to 8.5 or less.

4. The inkjet recording medium according to claim 1, wherein the support is a water-absorbent support, and wherein the water-absorbent support comprises at least one selected from the group consisting of a diffusible sulfinic acid compound and a diffusible thiosulfonic acid compound.

5. An inkjet recording medium according to claim 1, wherein the ink receiving layer comprises a high concentration part with a relatively high sulfur-containing organic acid concentration and a low concentration part with a relatively low sulfur-containing organic acid concentration, and wherein the high concentration part is located closer to the recording surface than the low concentration part.

6. An inkjet recording medium according to claim 1, wherein the ink receiving layer comprises a high concentration part with a relatively high sulfur-containing organic acid concentration and a low concentration part with a relatively low sulfur-containing organic acid concentration, wherein the high concentration part is located closer to the recording surface than the low concentration part, and wherein the ink receiving layer has a surface and interior pH from 5.0 or more to 8.5 or less.

7. The inkjet recording medium according to claim 1, wherein the at least one sulfur-containing organic acid comprises:

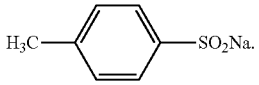

8. The inkjet recording medium according to claim 1, wherein the at least one sulfur-containing organic acid comprises a diffusible thiosulfonic acid compound.

* * * * *